US008111870B2

(12) United States Patent
Lemarquand et al.

(10) Patent No.: US 8,111,870 B2
(45) Date of Patent: Feb. 7, 2012

(54) ELECTRODYNAMIC TRANSDUCER AND USE THEREOF IN LOUDSPEAKERS AND GEOPHONES

(75) Inventors: Guy Lemarquand, Le Mans (FR); Bernard Richoux, Montoire (FR); Valérie Lemarquand, Le Mans (FR)

(73) Assignees: Universite du Maine, Le Mans (FR); Gilles Milot, Mayet (FR)

( * ) Notice: Subject to any disclaimer, the term of this patent is extended or adjusted under 35 U.S.C. 154(b) by 813 days.

(21) Appl. No.: 12/092,593

(22) PCT Filed: Nov. 2, 2006

(86) PCT No.: PCT/FR2006/051133

§ 371 (c)(1),
(2), (4) Date: Sep. 16, 2008

(87) PCT Pub. No.: WO2007/051949

PCT Pub. Date: May 10, 2007

(65) Prior Publication Data

US 2009/0028375 A1 Jan. 29, 2009

(30) Foreign Application Priority Data

Nov. 3, 2005 (FR) ..... 05 53331

(51) Int. Cl.
*H04R 1/00* (2006.01)
*H04R 9/06* (2006.01)
*H04R 11/02* (2006.01)

(52) U.S. Cl. ..... 381/412; 381/414

(58) Field of Classification Search ..... 381/412, 381/419, 421, 414

See application file for complete search history.

(56) References Cited

U.S. PATENT DOCUMENTS

| | | | | |
|---|---|---|---|---|
| 5,371,806 | A | 12/1994 | Kohara et al. | |
| 7,016,515 | B2 * | 3/2006 | Ohashi | 381/406 |
| 2002/0131612 | A1 * | 9/2002 | Son | 381/150 |
| 2004/0091130 | A1 * | 5/2004 | Goller | 381/412 |
| 2004/0105568 | A1 * | 6/2004 | Lee | 381/412 |
| 2004/0146174 | A1 * | 7/2004 | Iwasa et al. | 381/396 |
| 2007/0140522 | A1 * | 6/2007 | Stewart | 381/421 |
| 2007/0237352 | A1 * | 10/2007 | Andersen et al. | 381/414 |
| 2008/0170745 | A1 * | 7/2008 | Kim et al. | 381/412 |

FOREIGN PATENT DOCUMENTS

| | | | |
|---|---|---|---|
| EP | 0 503 860 | A2 | 9/1992 |
| EP | 1 420 610 | A1 | 5/2005 |
| EP | 1 533 802 | A2 | 7/2005 |
| FR | 2 766 028 | A | 1/1999 |

* cited by examiner

*Primary Examiner* — Walter L Lindsay, Jr.
(74) *Attorney, Agent, or Firm* — Young & Thompson

(57) ABSTRACT

An electrodynamic transducer includes a frame and contains at least one electric coil which is placed in a static magnetic field and which can move about a rest position in a vertical free space. The coil(s) is wound around and fixed to a mandrel and a return member is used to return the coil-bearing mandrel to the rest position in the absence of an external bias, the straight cylinder defining an inner volume and an outer volume. The magnetic field is produced by outer and inner magnetic structures which each comprise at least one fixed permanent magnet in the form of a ring. The motor does not contain any ferromagnetic or magnetic part between the outer volume and the inner volume. At least the part of the frame that is used to fix the magnets is made from a non-ferromagnetic and non-magnetic material.

20 Claims, 8 Drawing Sheets

Figure 1:
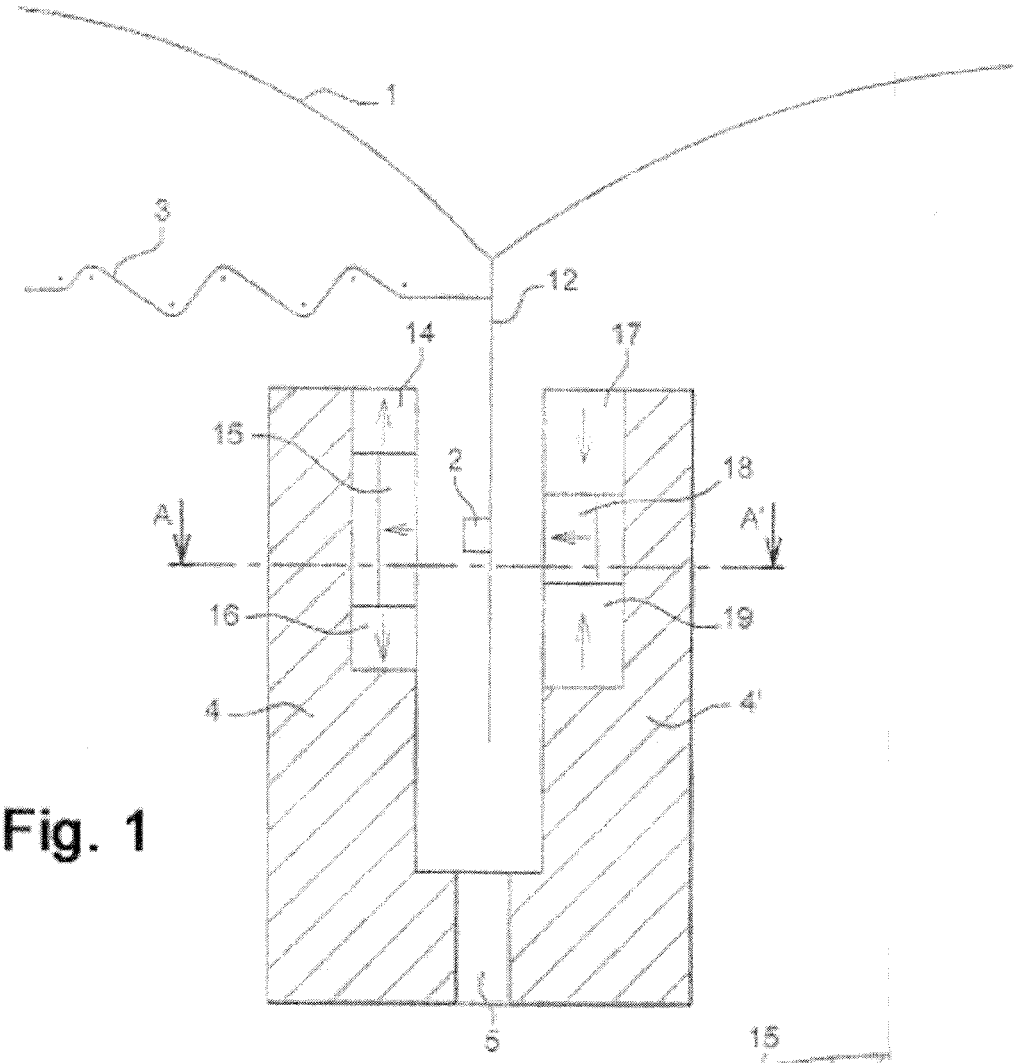

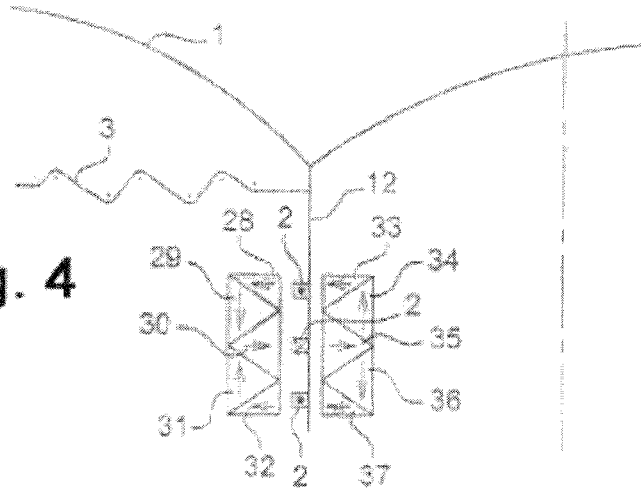
Fig. 4
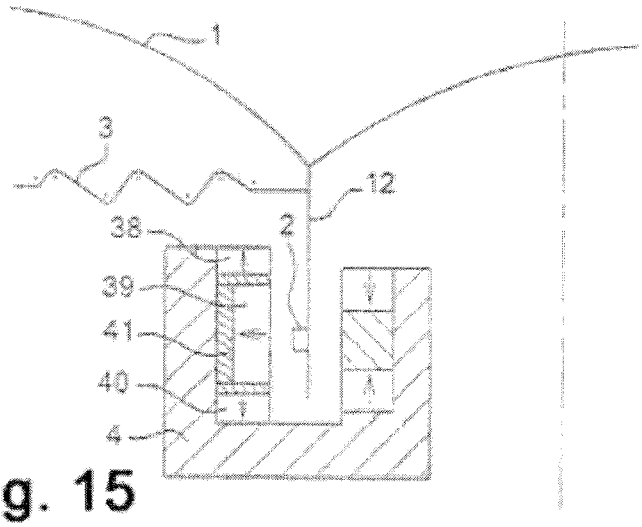
Fig. 15
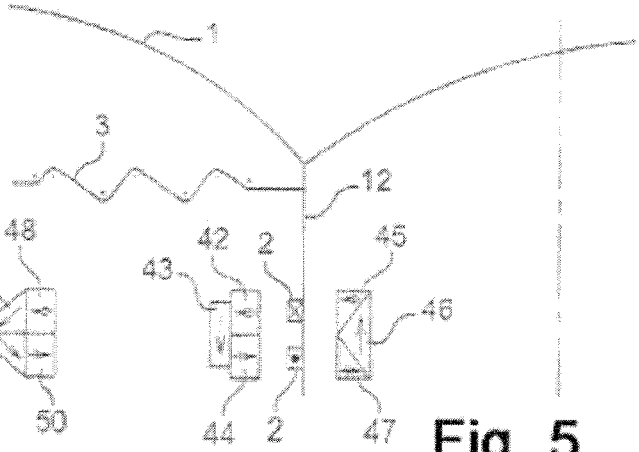
Fig. 5a
Fig. 5

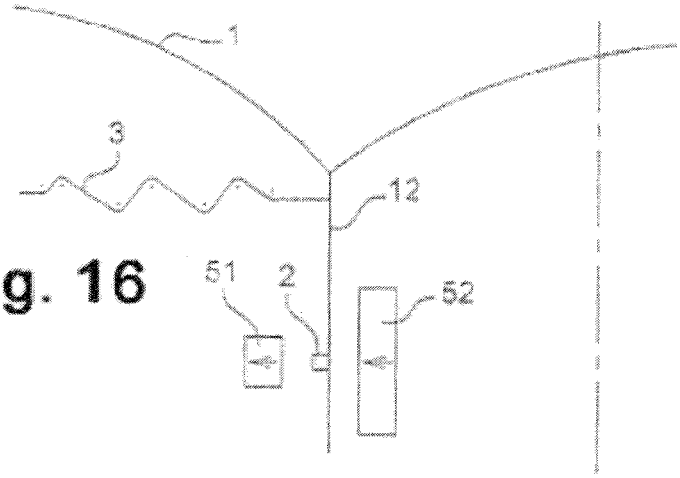
Fig. 16
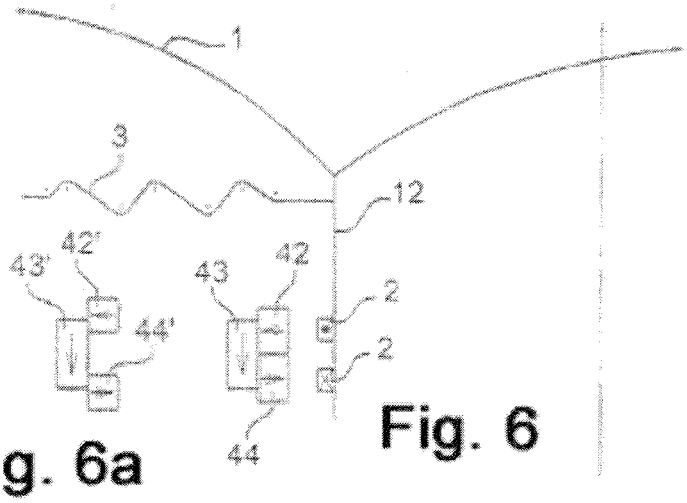
Fig. 6a
Fig. 6
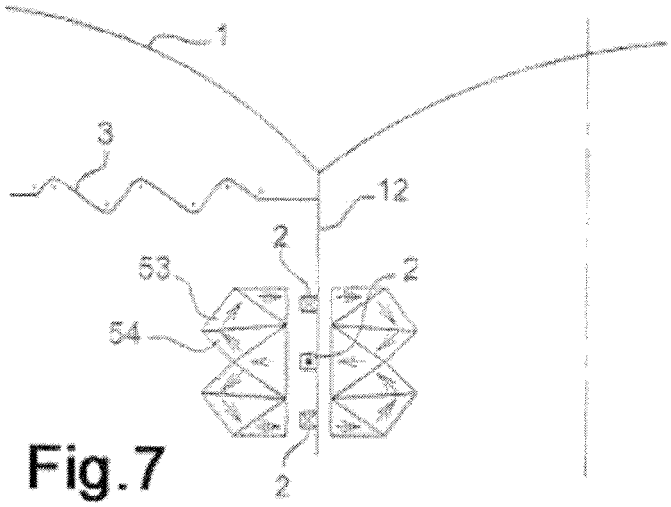
Fig.7

ELECTRODYNAMIC TRANSDUCER AND USE THEREOF IN LOUDSPEAKERS AND GEOPHONES

BACKGROUND OF THE INVENTION

The present invention relates to an electrodynamic transducer as well as the applications thereof to loudspeakers, geophones (sensor for seismograph), microphones or the like.

DESCRIPTION OF THE RELATED ART

Functional constructions for axisymmetric, moving coil type electrodynamic transducers, of electrodynamic loudspeaker type (electro-acoustic converter) generating acoustic waves in response to a current, or of acoustic or vibration sensor type (acoustic-electric converter) generating an electric signal in response of a mechanical stimulus, are known and numerous improvements have been proposed to increase their efficiency while reducing the distortions for high mechanical excursions.

The general operating principle for axisymmetric, moving coil type loudspeakers, is based on the possibility to set in motion a cylindrical coil carrying an electric current, placed in a static magnetic field created by an annular permanent magnet whose magnetization orientation is parallel to the revolution axis and channeled by a plurality of ferromagnetic parts so as to be brought radially relative to the coil and, for the sensors, it is based on the possibility to pick-up the current induced in a coil moving in a static magnetic field. The magnetic field is produced by one or more fixed permanent magnet(s) of the transducer. The efficiency being proportional to the magnetic field, the magnetic field lines has to be concentrated to the coil by mean of parts which conduct the magnetic field lines and which are ferromagnetic. A ferromagnetic material generally used is soft iron. So, the term "air gap" has been used to indicate the place where the coil is located. Constructions classically implemented in this type of transducers use such so-called "ferromagnetic" parts to loopback the magnetic field in order for it to be able to go through the coil in the air gap.

General explanations and examples about loudspeaker type transducers can be found for example in "HIGH PERFORMANCE LOUDSPEAKERS" by Martin Colloms, edited by WILEY, ISBN 0471 97091 3 PPC.

Generally, a ferromagnetic material has the property that the magnetic permeability thereof is much greater than that of vacuum, so as in particular to channel and conduct the magnetic flux as long as the material is not saturated. Soft iron, iron-and-cobalt or iron-and-nickel alloys are ferromagnetic. An amagnetic material is a material that does not have any magnetic property, the permeability thereof relative to the magnetic field is the same as that of vacuum or air, and it does not have any property of magnetic field channeling or conduction. Wood, light alloys, copper, plastic materials are non-magnetic.

Now, the power of magnets increases in a progressive manner and ferromagnetic materials can be saturated by too strong magnetic fields, whereupon it becomes impossible to take advantage of that power increase. Greater sections of iron have therefore been used in transducers that use strong magnets. However, losses occur in ferromagnetic material and the outgoing magnetic field is no longer homogeneous and decreases as the distance from the magnet increases. Further, the presence of such materials changes the inductance of the coil and involves changes in this inductance when the coil moves within the air gap. Finally, so-called "Foucault currents" induced in those ferromagnetic parts can still disturb the transducer operation.

In the article "Analytical Calculation of Ironless Loudspeaker Motors" by G. Lemarquand et al., IEEE Transactions on Magnetics, Vol. 37, No 3, pp 1110-1117, 2001, it has been proposed to make a loudspeaker motor without iron, but that one uses a loopback of the magnetic field to the space in which the coil is located by mean of physical elements that are permanent magnets.

EP 0 503 860, House, proposes a transducer having a magnetic construction, either internal or external, with a coil, the construction being comprised of a stack of vertical, horizontal and vertical pole magnets separated by spacers.

EP 1 553 802, Ohashi, relates to a symmetric loudspeaker with a double diaphragm and an external magnetic construction having vertical, horizontal and vertical poles.

SUMMARY OF THE INVENTION

The present invention proposes to take advantage of the whole power of the magnets by avoiding the use of ferromagnetic or magnetic materials to loopback, by physical guidance, the magnetic field created by one or more magnets of a transducer.

Therefore, the invention relates to an electrodynamic transducer having a yoke and in which at least one electrical coil placed in a static magnetic field can move about a rest position in an excursion range of a vertical free space, the coil(s) being wound and fixed on a segment of circular or elliptical cross-sectioned vertical straight cylinder forming a mandrel, a return mean enabling the mandrel bearing the coil(s) to be returned to the rest position in the absence of an external bias, the straight cylinder defining an internal volume toward the inside of said cylinder and defining an external volume toward the outside of said cylinder. (For the purpose of explanations and given that there is no loopback of the magnetic field by mean of physical elements, the internal and external volumes, which are virtual ones, are not limited upward and downward unlike the mandrel the height of which is limited and which is a physical part of the transducer).

According to the invention, the magnetic field is produced by an external magnetic construction (outside said cylinder) comprising at least one ring-shaped fixed permanent magnet arranged inside the external volume as well as an internal magnetic construction (inside said cylinder) comprising at least one ring-shaped or pellet-shaped fixed permanent magnet arranged inside the internal volume, the external and internal magnetic constructions being substantially in a face to face relation on either side of the vertical free space, said motor comprising no ferromagnetic or magnetic part extending between the external volume and the internal volume, the yoke, at least in the part thereof that holds the magnets in a fixed position, being made of a non-ferromagnetic and non-magnetic material, and the ratio R of the inductance value $L_p$ of the coil at the rest position and blocked in the transducer to the inductance value $L_1$ of the same coil when free and isolated in the space, namely $R=L_p/L_1$, having a value comprised between 0.9 and 1.1 in the useful frequency band of the transducer.

Therefore, in any case, with ferromagnetic part(s) present or not, the motor does not comprise any ferromagnetic or magnetic part extending between the external volume and the internal volume.

The straight cylinder is a cylinder whose generating lines are perpendicular to the base plane. In case the base plane is a disc, so that the generating line runs on a circle, the cylinder is a revolution cylinder (for example, a circular loudspeaker). The base plane can have another shape, specially an elliptical shape (for example, an elliptical loudspeaker) or even a polygonal shape and specially, in the latter case, a substantially square or rectangular shape with possibly round corners. The ring shape corresponds substantially (to within about a radial homothetic transformation) to the cylindrical shape of the mandrel. It is to be understood that the top, bottom, upper or lower indications are relative indications and are intended to facilitate the description and to be associated with the attached figures, and that the applications of the transducer can lead the transducer to be turned in a different manner without the characteristics thereof being changed. An outgoing pole face is a magnet face by which the internal magnetic field of the magnet can escape from the magnet; it is called "pole face" because it can be of north or south sign, a juxtaposition of opposite sign pole faces of two juxtaposed adjacent magnets corresponding to a contact between a south face and a north face. A horizontal (or vertical or other) internal field indicates the general orientation of the magnetic field lines within a magnet, and the magnet faces which are parallel to that orientation are not outgoing pole faces.

The term "yoke" corresponds generally to one or more transducer fixed part(s) on which are fitted mobile members (specially suspensions) or fixed members (specially motor magnets) and which enable these members to be held in fixed dynamic functional relations enabling the normal operation of the transducer. In case of a loudspeaker, the yoke is the rigid rear part (opposite to the diaphragm which is on the front side) on which are fixed, peripherally, a suspension for the diaphragm, and centrally, the motor's magnets. Finally, the term "vertical free space" corresponds to the area in which the mandrel bearing the coil(s) can circulate freely in the vertical direction, and the faces of said area which correspond to the edges of the internal and external magnetic constructions have preferably a substantially straight and vertical cross-section, but they nevertheless can be profiled in order to regulate the magnetic field in the vertical free space.

Figure 2:
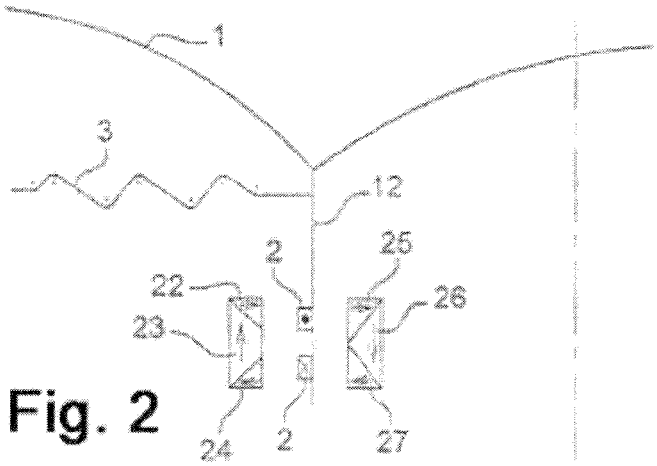
Figure 3:
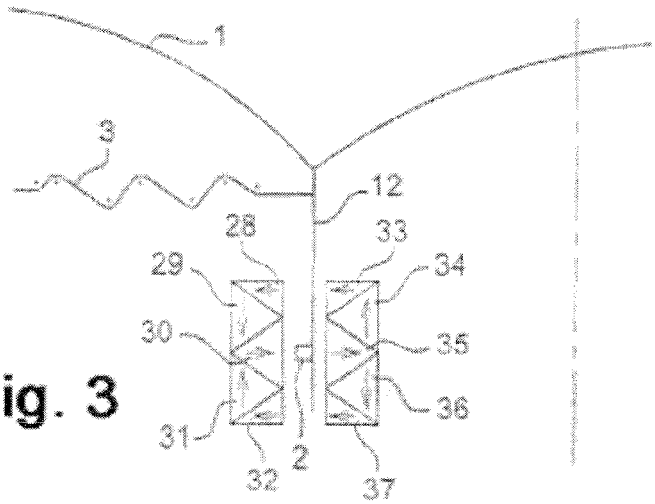
Figure 8:
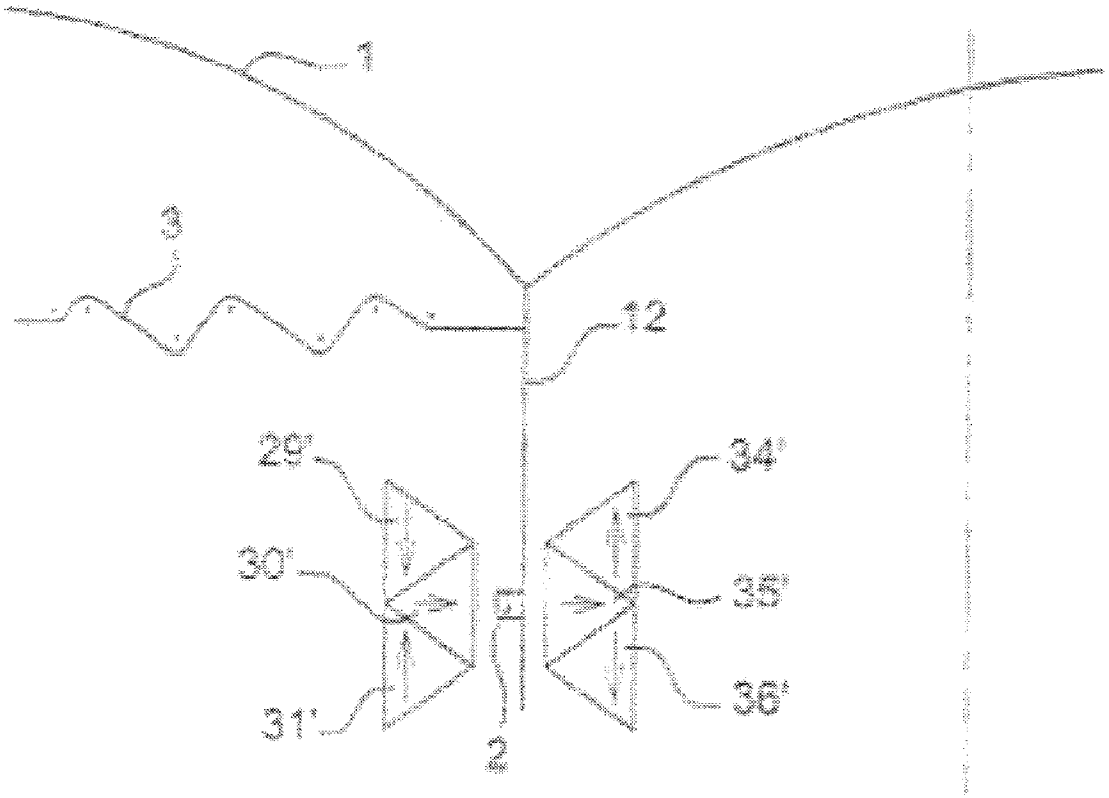
Figure 9:
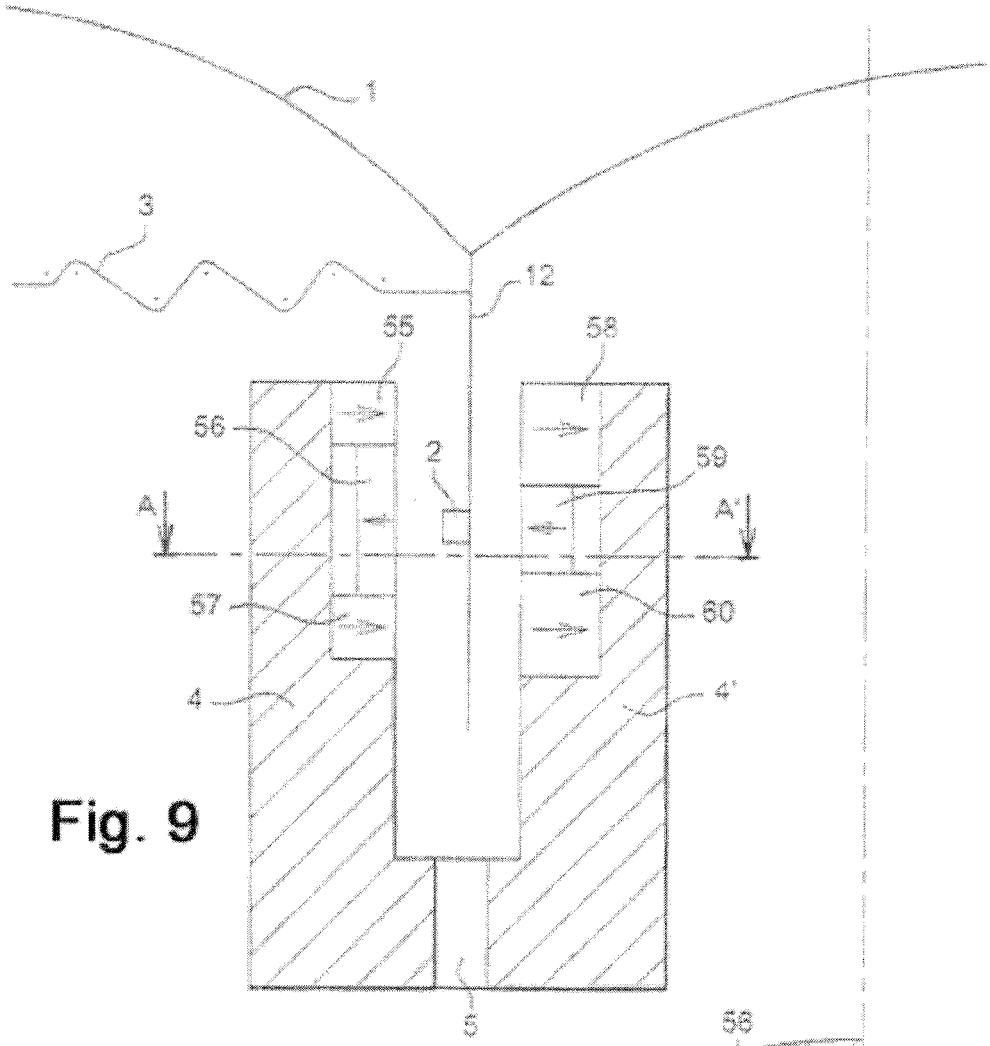
Figure 10:
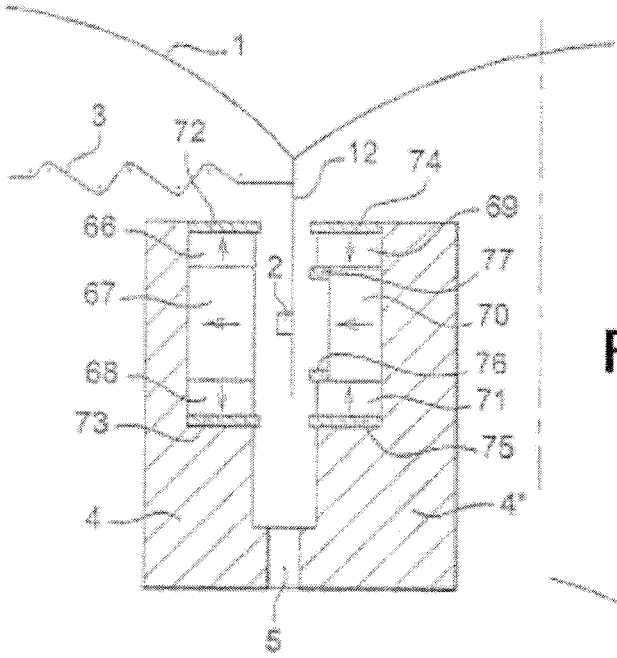

In various embodiments of the invention, following means are used, which can be used alone or in any technically possible combination:

- the non-ferromagnetic and non magnetic (i.e. amagnetic) material is a light alloy or a plastic material (thermoplastic or thermosetting),
- no ferromagnetic part is arranged inside the volume defined by the horizontal planes passing through the ends of the coil(s) in the rest position,
- no ferromagnetic part is arranged inside the volume defined by the horizontal planes passing through the far end positions of the ends of the coil(s) in the excursion range,
- the transducer does not comprise any ferromagnetic part,
- the transducer does not comprise any ferromagnetic part or, if at least one ferromagnetic part not extending between the external volume and the internal volume is present, then the ratio R of the inductance value $L_p$ of the coil at the rest position and blocked in the transducer to the inductance value $L_1$ of the same coil when free and isolated in the space, namely $R=L_p/L_1$, has a value comprised between 0.9 and 1.1 in the useful frequency band of the transducer, because said ferromagnetic part is saturated by the magnetic field and the magnetic permeability properties thereof are then close to that of amagnetic materials,
- during the movements of the coil in the transducer, the ratio R remains between 0.9 and 1.1 because, even if at least one ferromagnetic part not extending between the external volume and the internal volume is present, said ferromagnetic part is saturated by the magnetic field and the magnetic permeability properties thereof are then close to that of amagnetic materials,
- at least one ferromagnetic part is present, said ferromagnetic part not extending between the external volume and the internal volume and being not either arranged inside the volume defined by the horizontal planes passing through the ends of the coil(s) in the rest position,
- the adjacent and juxtaposed internal field outgoing pole faces of two magnets are juxtaposed over their whole surfaces,
- the adjacent and juxtaposed internal field outgoing pole faces of two magnets are juxtaposed over their whole surfaces and of opposite signs,
- further, the magnetic field is produced by an internal magnetic construction (inside said cylinder) comprising at least one annular-shaped (=tube=crown=ring) or a pellet-shaped (=solid, not opened in the center, and generally called segment or block magnet) fixed permanent magnet, arranged inside the internal volume, the external and internal magnetic constructions being substantially in a face to face relation (i.e. substantially at the same height) on either side of the vertical free space,
- in case both an internal and an external magnetic constructions are present, the vertical or substantially vertical internal field magnets in a face to face relation on either side of the vertical free space have opposite direction vertical or substantially vertical internal fields,
- in case both an internal and an external magnetic constructions are present, the horizontal internal field magnets in a face to face relation on either side of the vertical free space have same direction horizontal internal fields,
- preferably, the internal magnetic construction is a ring,
- the external bias on the mandrel is mechanical and the coil(s) can carry an electric voltage induced by the movements of the mandrel, specially in case of application to a geophone or to a microphone,
- the external bias is electrical and the coil(s) can carry an electric current intended to create a resultant force inducing the movement of the mandrel, specially in case of application to a loudspeaker, and during the upward or downward movements of the mandrel, movements which are produced by a current having a corresponding given direction, the mandrel is braked after a free course about the rest position, the resultant force decreasing and reversing for the same current direction beyond the free course, the one or at least one of the coils being then subjected to a magnetic field of reverse direction relative to the magnetic field direction to which it was previously subjected,
- the transducer comprises in the external and/or internal magnetic constructions, in a vertical arrangement, an upper magnet separated from a lower magnet by a gap, the magnets having a substantially square or rectangular cross-section and having their internal fields vertically oriented and of opposite directions, and, in case both an internal and an external magnetic constructions are present, the magnets in a face to face relation on either side of the vertical free space have opposite directions internal fields,
- the transducer further comprises a substantially square or rectangular cross-sectioned fixed intermediate magnet arranged in the gap and having a horizontal internal field direction, so that the intermediate magnetic field in the vertical free space has a reverse direction relative to the direction of the two upper and lower magnetic fields of said vertical free space, for a maximal loopback of the field lines (relative to other internal field direction arrangements in which magnets would be in opposition, what would lead to a reduction of the field in the vertical free space), the horizontal thickness of the intermediate magnet is smaller than (or, according to some variants, greater than or equal to) the horizontal width of each respective upper or lower magnet, the respective upper, lower magnets with opposite vertical internal fields and intermediate magnet are juxtaposed, (as an alternative to the latter) the respective upper, lower magnets with opposite vertical internal fields and possible intermediate magnet are not juxtaposed (a construction in which the upper and lower magnets are not juxtaposed or a construction in which the upper, intermediate and lower magnets are not juxtaposed), the upper and/or lower magnets and/or the possible intermediate magnet are composite magnets, comprised of an assembly of magnets having a substantially prismatic cross-section, and specially a triangular or truncated-triangular cross-section, and the adjacent internal field outgoing pole faces of two juxtaposed magnets are juxtaposed over their whole surfaces et of opposite signs, the transducer comprises in the external and/or internal magnetic constructions a globally square or rectangular cross-sectioned composite magnetic ring or pellet (a ring in the case of the external magnetic construction) (a ring or a pellet in the case of the internal magnetic construction) comprised of a stack of juxtaposed magnets, each magnet having a prismatic section, and specially a triangular or truncated-triangular cross-section, and the adjacent internal field outgoing pole faces of two juxtaposed magnets are of opposite signs, with from top to bottom: an upper magnet having a horizontal internal field and whose vertical height decreases as the distance from the vertical free space increases, an intermediate magnet having a vertical internal field and whose vertical height increases as the distance from the vertical free space increases, a lower magnet having a horizontal internal field and whose vertical height decreases as the distance from the vertical free space increases, the horizontal internal field direction of the upper magnet being opposite to the horizontal internal field direction of the lower magnet, the directions of the horizontal and vertical internal fields being such that the upper magnetic field in the vertical free space is of reverse direction relative to the direction of the lower magnetic field of the vertical free space, and for a maximal loopback of the field lines (relative to other internal field direction arrangements in which magnets would be in opposition, what would lead to a reduction of the field in the vertical free space), the transducer having two coils with opposite current-flow directions arranged at rest substantially at the height of the upper and lower magnets respectively, the transducer comprises in the external and/or internal magnetic constructions a globally square or rectangular cross-sectioned composite magnetic ring or pellet (a ring in the case of the external magnetic construction) (a ring or a pellet in the case of the internal magnetic construction) comprised of a stack of juxtaposed magnets, each magnet having a prismatic section, and specially a triangular or truncated-triangular cross-section, and the adjacent internal field outgoing pole faces of two juxtaposed magnets are of opposite signs, with from top to bottom: an upper magnet having a first direction of horizontal internal field and whose vertical height decreases as the distance from the vertical free space increases, an upper intermediate magnet having a first direction of vertical internal field, an central magnet having a second direction of horizontal internal field opposite to the first direction of horizontal internal field and whose vertical height decreases as the distance from the vertical free space increases, an lower intermediate magnet having a second direction of vertical internal field opposite to the first direction of vertical internal field, a lower magnet having a first direction of horizontal internal field and whose vertical height decreases as the distance from the vertical free space increases, the directions of the horizontal and vertical internal fields being such that the central magnetic field in the vertical free space is of reverse direction relative to the direction of the two upper and lower magnetic fields in the vertical free space, and for a maximal loopback of the field lines, the transducer having a coil arranged at rest substantially at the height of the central magnet or three coils with alternate current-flow directions arranged at rest substantially at the height of the upper, central and lower magnets respectively, the above magnet has therefore either only one central coil or three coils: upper coil, central coil, lower coil (with alternate current-flow directions between two adjacent coils), at least one of the magnets of the external and/or internal magnetic constructions results from the juxtaposition of at least two magnets having a prismatic cross-section, and specially a triangular or truncated-triangular cross-section, with oblique internal field orientations, and the adjacent internal field outgoing pole faces of two juxtaposed magnets are of opposite signs, wherein the vertical face of the magnetic construction opposite to the face bounding the vertical free space can be indented, the adjacent internal field outgoing pole faces of two juxtaposed magnets are juxtaposed over their whole surfaces, the vertical face of the magnetic construction opposite to the face bounding the vertical free space does not comprise any outgoing pole face, the transducer comprises in the external and/or internal magnetic constructions, in a vertical arrangement, a stack of an upper magnet separated from a lower magnet by a gap, the magnets having a substantially square or rectangular cross-section and having their internal fields horizontally oriented and of opposite directions, the transducer having two coils with opposite current-flow directions arranged at rest substantially at the height of the upper and lower magnets respectively, and, in case both an internal and an external magnetic constructions are present, the magnets in a face to face relation on either side of the vertical free space have same direction internal fields, the gap between the upper and lower magnets is null, said magnets being juxtaposed, the magnetic construction further comprises, toward the external face thereof opposite to the face bounding the vertical free space, separated from or preferably juxtaposed to the upper and lower magnets, a substantially square or rectangular cross-sectioned lateral magnet having a vertical internal field, the adjacent internal field outgoing pole faces of the upper magnet and the lateral magnet, which are substantially perpendicular to each other, being of opposite signs, the adjacent internal field outgoing pole faces of the lower magnet and the lateral magnet, which are substantially perpendicular to each other, being of opposite signs, the vertical length of the lateral magnet is smaller than the total height of the stack, the magnetic construction further comprises, toward the external face thereof opposite to the face bounding the vertical free space, separated from or preferably juxtaposed to the upper and lower magnets, a substantially prismatic cross-sectioned composite lateral magnet resulting from the juxtaposition of at least two triangular or truncated-triangular cross-sectioned magnets, with oblique internal field orientations, the adjacent internal field outgoing pole faces of the upper magnet and the respective magnet of the composite lateral magnet being of opposite signs, the adjacent internal field outgoing pole faces of two juxtaposed magnets of the composite lateral magnet being of opposite signs, the adjacent internal field outgoing pole faces of the lower magnet and the respective magnet of the composite lateral magnet being of opposite signs, the maximal vertical length of the composite lateral magnet is equal to or smaller than the total height of the assembly, the adjacent internal field outgoing pole faces of the upper magnet and the respective magnet of the composite lateral magnet being juxtaposed over their whole surfaces, the adjacent internal field outgoing pole faces of two juxtaposed magnet of the composite lateral magnet being juxtaposed over their whole surfaces, the adjacent internal field outgoing pole faces of the lower magnet and the respective magnet of the composite lateral magnet being juxtaposed over their whole surfaces, the magnetic constructions corresponding to an edge-to-edge assembly of magnetic rings are single-piece, the construction being a mass of magnetic material which contains inside of it areas whose magnetization directions are opposite to each other, the transducer comprises in the external and/or internal magnetic constructions, in a vertical arrangement, an upper magnet separated from a lower magnet by a gap, the magnets having a substantially square or rectangular cross-section and having their internal fields horizontally oriented and in the same direction, and, in case both an internal and an external magnetic constructions are present, the magnets in a face to face relation on either side of the vertical free space have same direction internal fields, the transducer further comprises a substantially square or rectangular cross-sectioned fixed intermediate magnet arranged in the gap and having a horizontal internal field direction, so that the intermediate magnetic field in the vertical free space has a reverse direction relative to the direction of the two upper and lower magnetic fields of said vertical free space, for a maximal loopback of the field lines (relative to other internal field direction arrangements in which magnets would be in opposition, what would lead to a reduction of the field in the vertical free space), (in other words, the horizontal internal field direction of the intermediate magnet is opposite to the horizontal internal field direction of the upper and lower magnets), the horizontal thickness of the intermediate magnet is smaller than, equal to or greater than the horizontal width of each respective upper or lower magnet, the respective upper, lower magnets with same direction horizontal internal fields and possible intermediate magnet are juxtaposed (a construction in which the upper and lower magnets are juxtaposed or a construction in which the upper, intermediate and lower magnets are juxtaposed), (as an alternative to the latter) the respective upper, lower magnets with opposite vertical internal fields and possible intermediate magnet are not juxtaposed (a construction in which the upper and lower magnets are not juxtaposed or a construction in which the upper, intermediate and lower magnets are not juxtaposed), (FIG. 1)

the transducer comprises: on one part, in the external magnetic construction, in a vertical arrangement, an external upper magnet separated from an external lower magnet by an external gap, the external magnets having their internal fields vertically oriented and of opposite directions, and on the other part, in the internal magnetic construction, in a vertical arrangement, an internal upper magnet separated from an internal lower magnet by an internal gap, the internal magnets having their internal fields vertically oriented and of opposite directions, the internal and external upper magnets being substantially at the same height on either side of the vertical free space and of opposite internal field directions, the internal and external lower magnets being substantially at the same height on either side of the vertical free space and of opposite internal field directions, a ring-shaped fixed external intermediate magnet being arranged in the external gap and a ring-shaped fixed internal intermediate magnet being arranged in the internal gap, the internal and external intermediate magnets having the same horizontal internal field direction so that the intermediate magnetic field in the vertical free space is of reverse direction relative to the direction of the two upper and lower magnetic fields of said vertical free space, for a maximal loopback of the field lines (relative to other internal field direction line arrangements in which magnets would be in opposition, what would lead to a reduction of the field in the vertical free space), the transducer having only one coil arranged at rest substantially at the height of the external and internal gaps, the respective intermediate, upper and lower magnets, either external magnets or internal magnets, being juxtaposed to each other, the horizontal thickness of the intermediate magnet is smaller or greater than (according to a variant, equal to) the horizontal width of the respective upper and lower magnets, either external magnets or internal magnets, as an alternative, the intermediate magnet is not juxtaposed to its respective upper and lower magnets, as an alternative, the transducer comprises three coils with alternate current-flow directions from one coil to another, each being located in one of the fields of the vertical free space, (FIG. 2)

the transducer comprises: on one part, in the external magnetic construction, in a vertical arrangement, an external upper magnet separated from an external lower magnet by an external gap, the external magnets having a prismatic cross-sectioned, and specially a triangular or truncated-triangular cross-sectioned, ring shape, and having their internal fields horizontally oriented and of opposite directions, and on the other part, in the internal magnetic construction, in a vertical arrangement, an internal upper magnet separated from an internal lower magnet by an internal gap, the internal magnets having a prismatic cross-sectioned, and specially a triangular or truncated-triangular cross-sectioned, ring shape and having their internal fields horizontally oriented and of opposite directions, the internal and external upper magnets being substantially at the same height on either side of the vertical free space and of same internal field direction, the internal and external lower magnets being substantially at the same height on either side of the vertical free space and of same internal field direction, the height of the gap decreasing as the distance from the vertical free space decreases, a fixed external intermediate magnet having a prismatic cross-sectioned, and specially a triangular or truncated-triangular cross-sectioned, ring shape being arranged in the external gap and a fixed internal intermediate magnet having a prismatic cross-sectioned, and specially a triangular or truncated-triangular cross-sectioned, ring shape or solid shape being arranged in the internal gap, the internal fields of the external and internal intermediate magnets being vertically oriented and of opposite directions, so that the magnetic field in the vertical free space comprises two areas of reverse direction magnetic fields, and for a maximal loopback of the field lines (relative to other internal field direction arrangements in which magnets would be in opposition, what would lead to a reduction of the field in the vertical free space), the respective intermediate, upper and lower magnets, either external magnets or internal magnets, being complementarily juxtaposed, the transducer having two coils with opposite current-flow directions each arranged at rest substantially at the height of the upper and lower magnets respectively, the external or internal magnetic construction has a globally square or rectangular cross-section, the gap decreases until it becomes null on the edge of the vertical free space, the respective upper and lower magnets being at this point substantially in contact (in other words, the prismatic cross-section of the intermediate magnet is a triangular cross-section), (FIG. 3)

the transducer comprises: on one part, in the external magnetic construction, a globally square or rectangular cross-sectioned external composite crown comprised of a stack of juxtaposed magnets, each magnet having a prismatic cross-sectioned, and specially a triangular or truncated-triangular cross-sectioned, ring shape complementary of that of the neighbors thereof, and the adjacent internal field outgoing pole faces of two juxtaposed magnets are of opposite signs, with from top to bottom: an external upper magnet having a first direction of horizontal internal field and whose vertical height decreases as the distance from the vertical free space increases, an external upper intermediate magnet having a first direction of vertical internal field, an external central magnet having a second direction of horizontal internal field opposite to the first direction of horizontal internal field and whose vertical height decreases as the distance from the vertical free space increases, an external lower intermediate magnet having a second direction of vertical internal field opposite to the first direction of vertical internal field, an external lower magnet having a first direction of horizontal internal field and whose vertical height decreases as the distance from the vertical free space increases, and on the other part, in the internal magnetic construction, in a vertical arrangement, a globally square or rectangular cross-sectioned tubular composite core comprised of a stack of juxtaposed magnets, each magnet having a prismatic cross-sectioned, and specially a triangular or truncated-triangular cross-sectioned, ring shape complementary of that of the neighbors thereof, and the adjacent internal field outgoing pole faces of two juxtaposed magnets are juxtaposed over their whole surface and of opposite signs, with from top to bottom: an internal upper magnet with a first direction of horizontal internal field and whose vertical height decreases as the distance from the vertical free space increases, an internal upper intermediate magnet having a second direction of vertical internal field, an internal central magnet having a second direction of horizontal internal field and whose vertical height decreases as the distance from the vertical free space increases, an internal lower intermediate magnet having a first direction of vertical internal field, an internal lower magnet having a first direction of horizontal internal field and whose vertical height decreases as the distance from the vertical free space increases, the external and internal upper magnets being substantially at the same height on either side of the vertical free space, the external and internal central magnets being substantially at the same height on either side of the vertical free space, the external and internal lower magnets being substantially at the same height on either side of the vertical free space, the directions of the horizontal and vertical internal field of the magnets being such that the central magnetic field in the vertical free space is of reverse direction relative to the direction of the two upper and lower magnetic fields of the vertical free space, and for a maximal loopback of the field lines (relative to other internal field direction arrangements in which magnets would be in opposition, what would lead to a reduction of the field in the vertical free space), the transducer having a central coil arranged at rest substantially at the height of the central magnets, the adjacent internal field outgoing pole faces of two juxtaposed magnets are juxtaposed over their whole surfaces, (FIG. 4)

the transducer further comprises an upper coil above the central coil, a lower coil below the central coil, the transducer having three coils, and in that, at rest, the upper coil is substantially arranged at the height of the upper magnets, the central coil is substantially arranged at the height of the central magnets, the lower coil is substantially arranged at the height of the lower magnets, the current-flow direction in the central coil is reverse to the direction in the upper and lower coils, (FIG. 7)

at least one of the intermediate magnets is an assembly of two juxtaposed magnets having complementary prismatic cross-sectioned, and specially triangular or truncated-triangular cross-sectioned, ring shapes, the internal field orientations of which being inclined at an angle smaller than 90° relative to the vertical, and the adjacent internal field outgoing pole faces of two juxtaposed magnets are of opposite signs, wherein the vertical face of the magnetic construction opposite to the face bounding the vertical free space can be indented and does not comprise any outgoing pole face, at least one of the intermediate magnets is an assembly of two juxtaposed magnets having complementary prismatic cross-sectioned, and specially triangular or truncated-triangular cross-sectioned, ring shapes, the internal field orientations of which being inclined at an angle of approximately 45°, in absolute value, relative to the vertical, and the adjacent internal field outgoing pole faces of two juxtaposed magnets are of opposite signs, wherein the vertical face of the magnetic construction opposite to the face bounding the vertical free space can be indented, the vertical face of the magnetic construction opposite to the face bounding the vertical free space does not comprise any outgoing pole face, the prismatic cross-section of the magnets is a triangular cross-section, (FIG. 6)

the external magnetic construction comprises, in a vertical arrangement, a stack of an external upper magnet juxtaposed to an external lower magnet, the external magnets having an approximately square or rectangular cross-section and having their internal fields horizontally oriented and of opposite directions, the external magnetic construction further comprising, toward the external face thereof opposite to the face bounding the vertical free space, juxtaposed to the assembly, a substantially square or rectangular cross-sectioned external lateral magnet having a vertical internal field, the adjacent internal field outgoing pole faces of the upper magnet and the lateral magnet, which are substantially perpendicular to each other, being of opposite signs, the adjacent internal field outgoing pole faces of the lower magnet and the lateral magnet, which are substantially perpendicular to each other, being of opposite signs, the transducer having two coils with opposite current-flow directions arranged at rest substantially at the height of the upper and lower magnets respectively, the vertical height of the external lateral magnet is smaller than the vertical height of the stack, the vertical height of the external lateral magnet is equal to the vertical height of the stack, the above magnetic construction is reversed in the transducer and ends up in the internal volume, (FIG. 5)

the transducer comprises: on one part, in the external magnetic construction, in a vertical arrangement, a stack of an external upper magnet juxtaposed to an external lower magnet, the external magnets having an approximately square or rectangular cross-section and having their internal fields horizontally oriented and of opposite directions, the external magnetic construction further comprising, toward the external face thereof opposite to the face bounding the vertical free space, juxtaposed to the assembly, a substantially square or rectangular cross-sectioned external lateral magnet having vertical internal field, the adjacent internal field outgoing pole faces of the upper magnet and the lateral magnet, which are substantially perpendicular to each other, being of opposite signs, the adjacent internal field outgoing pole faces of the lower magnet and the lateral magnet, which are substantially perpendicular to each other, being of opposite signs, and on the other part, in the internal magnetic construction, in a vertical arrangement, an internal upper magnet separated from an internal lower magnet by an internal gap, the internal magnets having a prismatic cross-sectioned, and specially triangular or truncated-triangular cross-sectioned, ring shape, the internal fields of which being horizontally oriented and of opposite directions, the height of the internal gap decreasing as the distance from the vertical free space decreases, a fixed internal intermediate magnet having a prismatic cross-sectioned ring shape being arranged in the internal gap, the adjacent internal field outgoing pole faces of two juxtaposed internal magnets being of opposite signs, the internal and external upper magnets being substantially at the same height on either side of the vertical free space and having the same internal field direction, the internal and external lower magnets being substantially at the same height on either side of the vertical free space and having the same internal field direction, the transducer having two coils with opposite current-flow directions arranged at rest substantially at the height of the upper and lower magnets respectively, the vertical height of the external lateral magnet is smaller than the vertical height of the stack, the above internal and external magnetic constructions are reversed, specially the intermediate magnet that ends up in the external volume and the lateral magnet in the internal volume, (FIG. 8)

the transducer comprises: on one part, in the substantially truncated-triangular cross-sectioned external magnetic construction, in a vertical arrangement, an external upper magnet separated from an external lower magnet by an external gap, the external magnets having a triangular or truncated-triangular cross-sectioned ring shape and having their internal fields vertically oriented and of opposite directions, and on the other hand, in the substantially truncated-triangular cross-sectioned internal magnetic construction, in a vertical arrangement, an internal upper magnet separated from an internal lower magnet by an internal gap, the internal magnets having a triangular cross-sectioned ring shape and having their internal fields vertically oriented and of opposite directions, the internal and external upper magnets being substantially at the same height on either side of the vertical free space and of opposite internal field directions, the internal and external lower magnets being substantially at the same height on either side of the vertical free space and of opposite internal field directions, the height of the gap increasing as the distance from the vertical free space decreases, a fixed external intermediate magnet having a triangular cross-sectioned ring shape being arranged in the external gap and a fixed internal intermediate magnet having a triangular cross-sectioned ring shape being arranged in the internal gap, the internal field of the external and internal intermediate magnets being of the same direction and horizontally oriented, so that the magnetic field in the vertical free space comprises three magnetic field areas having alternate directions, and for a maximal loopback of the field lines, the respective intermediate, upper and lower magnets, either external magnets or internal magnets, being complementarily juxtaposed, the transducer having at least one coil arranged at rest substantially at the height of the intermediate magnets, (FIG. 9)

the transducer comprises: on one part, in the external magnetic construction, in a vertical arrangement, an external upper magnet separated from an external lower magnet by an external gap, the external magnets having their internal fields horizontally oriented and in the same direction, and on the other hand, in the internal magnetic construction, in a vertical arrangement, an internal upper magnet separated from an internal lower magnet by an internal gap, the internal magnets having their internal fields horizontally oriented and in the same direction, the internal and external upper magnets being substantially at the same height on either side of the vertical free space and having the same internal field direction, the internal and external lower magnets being substantially at the same height on either side of the vertical free space and having the same internal field direction, a ring-shaped fixed external intermediate magnet being arranged in the external gap and a ring-shaped fixed internal intermediate magnet being arranged in the internal gap, the external and internal intermediate magnets having the same horizontal internal field direction opposite to the direction of the other internal fields of the other magnets, so that the intermediate magnetic field in the vertical free space has a reverse direction relative to the direction of the two upper and lower magnetic fields of said vertical free space, for a maximal loopback of the field lines, the transducer having at least one coil arranged at rest substantially at the height of the external and internal gaps, the respective intermediate, upper and lower magnets, either external magnets or internal magnets, being juxtaposed to each other, (FIG. 10)

the transducer comprises: on one part, in the external magnetic construction, in a vertical arrangement, an external upper magnet separated from an external lower magnet by an external gap, the external magnets having their internal fields vertically oriented and of opposite directions, and on the other hand, in the internal magnetic construction, in a vertical arrangement, an internal upper magnet separated from an internal lower magnet by an internal gap, the internal magnets having their internal fields vertically oriented and of opposite directions, the internal and external upper magnets being substantially at the same height on either side of the vertical free space and of opposite internal field directions, the internal and external lower magnets being substantially at the same height on either side of the vertical free space and of opposite internal field directions, an external intermediate magnet being arranged in the external gap and an internal intermediate magnet being arranged in the internal gap, the internal and external intermediate magnets having the same horizontal internal field direction, so that the intermediate magnetic field in the vertical free space has a reverse direction relative to the direction of the two upper and lower magnetic fields of said vertical free space, for a maximal loopback of the field lines, the respective intermediate, upper and lower magnets, either external magnets or internal magnets, being juxtaposed to each other and being substantially square or rectangular cross-sectioned rings, the transducer having only one coil arranged at rest substantially at the height of the external and internal gaps, and it further comprises four ferromagnetic plates arranged two above the external and internal upper magnets and two below the external and internal lower magnets, and two ferromagnetic plates in the internal magnetic construction at the corners of the upper and lower ends of the internal intermediate magnet toward the vertical free space;

(FIG. 11)

the transducer comprises: on one part, in the external magnetic construction having a globally truncated-triangular cross-section the tip of which is directed toward the vertical free space, in a vertical arrangement, an external upper magnet separated from an external lower magnet by an external gap, the external magnets having their internal fields vertically oriented and of opposite directions, the height of the external gap increasing as the distance from the vertical free space decreases, an external intermediate magnet in the external gap and complementarily juxtaposed to the upper and lower external magnets, the external magnets having a triangular or truncated-triangular cross-sectioned ring shape, and on the other hand, in the globally rectangular or square cross-sectioned internal magnetic construction, in a vertical arrangement, an internal upper magnet separated from an internal lower magnet by an internal gap, the internal magnets having their internal fields vertically oriented and of opposite directions, the internal and external upper magnets having opposite internal field directions, the internal and external lower magnets having opposite internal field directions, an internal intermediate magnet being arranged in the internal gap, the internal and external intermediate magnets having the same horizontal internal field direction, so that the intermediate magnetic field in the vertical free space has a reverse direction relative to the direction of the two upper and lower magnetic fields of said vertical free space, for a maximal loopback of the field lines, the internal magnets having a square or rectangular cross-sectioned ring shape, and the internal magnetic construction further comprises two ferromagnetic plates arranged one above the upper magnet and one below the lower magnet, and two ferromagnetic plates at the corners of the upper and lower ends of the internal intermediate magnet toward the vertical free space;

the rings (for the external and internal magnetic constructions) or pellets (for the internal magnetic construction when it is possible) of the magnets are circumferentially continuous, the magnets being in one part (monolithic/single-piece ring), the rings (for the external and internal magnetic constructions) or pellets (for the internal magnetic construction when it is possible) of the magnets are circumferentially composite, the rings/pellets resulting from an assembly in which magnetic parts are circumferential juxtaposed to each other to form said rings or pellets, the external or internal magnetic constructions are monolithic/single-piece (a block magnet having an internal magnetic field being able to have different orientations/directions according the place), the external or internal magnetic constructions are composite, comprised of an assembly of rings/pellets which are themselves single-piece or not (monolithic/single-piece or composite rings/pellets), the mandrel has a circular horizontal cross-section, the mandrel has an elliptical horizontal cross-section, a ferromagnetic liquid (ferrofluid) is arranged inside the vertical free space and forms at least one ferrofluidic seal (unilateral or bilateral), the ferrofluidic seal is discontinuous along the circumference of the mandrel, the ferrofluidic seal is continuous along the circumference of the mandrel (it is pneumatically tight and allow isolation of the rear part of the diaphragm from the environment and avoid an acoustical short-circuit in case of absence of peripheral suspension of the edge type diaphragm—ferrofluidic guidance edgeless type loudspeaker), a ferromagnetic liquid (ferrofluid) is arranged within the vertical free space inside the internal volume to form at least one internal unilateral ferrofluidic seal (inside the internal volume within the cylinder/mandrel, the ferromagnetic liquid being therefore located between the mandrel and the internal magnetic construction of the motor), a ferromagnetic liquid (ferrofluid) is arranged within the vertical free space inside the external volume to form at least one external unilateral ferrofluidic seal (inside the external volume within the cylinder/mandrel, the ferromagnetic liquid being therefore located between the mandrel and the external magnetic construction of the motor), a ferromagnetic liquid (ferrofluid) is arranged within the vertical free space inside the external volume and inside the internal volume to form at least one external unilateral ferrofluidic seal and one internal unilateral ferrofluidic seal, or then at least one bilateral ferrofluidic seal, the transducer comprises a ferromagnetic liquid arranged in the vertical free space and form at least one ferrofluidic seal between the mandrel and at least one of the two faces of the vertical free space, the transducer is a dome-type loudspeaker and does not comprise any edge suspension or "spider" suspension, the guidance of the mandrel being provided by at least two ferrofluidic seals of ferromagnetic liquid, at least one of the ferrofluidic seals being continuous on the circumference of the mandrel to pneumatically isolate the air volume on the backside of the dome (volume inside the loudspeaker) from the ambient air (the ambient air is that who immerse the front face of the dome), the bottom of the vertical free space opposite to the membrane (dome) is closed (airtight, and an external unilateral continuous seal is then sufficient to ensure the pneumatic tightness of the rear face of the diaphragm), the bottom of the vertical free space opposite to the membrane is opened (an internal unilateral continuous seal is then sufficient to ensure the pneumatic tightness of the rear face of the diaphragm), the seals are arranged in a position along the height on a same side of the coil(s) (either all above or all below), in case of several coils, at least one of the seals is above or below the set of coils (the other seal(s) can be located between the coils or completely on the other side of the coils), advantageously, the seals are arranged in a position along the height on either side of the coil (in the case of several coils, two extreme seals can be provided on either side of the coils and/or seals can be provided between each coil/set of coils), at least one of the ferrofluidic seals is an internal and unilateral seal, the ferromagnetic liquid of said seal being arranged inside the internal volume (the internal volume is inside the coil-bearing mandrel, the ferromagnetic liquid being therefore located between the mandrel and the internal magnetic construction), at least one of the ferrofluidic seals is an external and unilateral seal, the ferromagnetic liquid of said seal being arranged inside the external volume (the external volume is outside the coil-bearing mandrel, the ferromagnetic liquid being therefore located between the mandrel and the external magnetic construction), at least one of the ferrofluidic seals is a bilateral seal, the ferromagnetic liquid of said seal being arranged inside the external volume and inside the internal volume, substantially at the same height for a same bilateral seal, the loudspeaker comprises only unilateral ferrofluidic seals, either exclusively external or exclusively internal, advantageously, the ferrofluidic seals are arranged in the space in which the volume is the most reduced (in practice, on the face of the mandrel which does not bear the coil), the ferrofluidic seals are external and unilateral seals, the coil is arranged inside the internal volume on the internal face of the mandrel and, when the seals are internal and unilateral seals, the coil is arranged inside the external volume on the external face of the mandrel, the loudspeaker further comprises a return mean for the coil, the loudspeaker further comprises a return mean for the coil selected among one or more of the following means:

loading of the diaphragm by a closed volume on the backside of the dome, the internal magnetic construction being opened toward the closed volume;

loading of the diaphragm by a closed volume on the backside of the dome, the internal magnetic construction being opened toward the closed volume which comprises an adjusting device for the internal pressure thereof, specially by adjustment of the temperature of the air contained in said closed volume (for a long-term balancing of the pressures between the closed volume and the external environment, with a long time constant relative to the frequencies to be reproduced);

loading of the diaphragm by a quasi-closed volume on the backside of the dome, the internal magnetic construction being opened toward said quasi-closed volume, said quasi-closed volume comprising a minimal pneumatic leakage (generally, a pressure balancing mean having a long time constant) the time constant of which is very long relative to the frequencies to be reproduced, said leakage having specially the form of a porous material or of a port with a very small diameter or of a fine tube (of capillary or needle type) toward the outside of the loudspeaker;

a mechanical return mean of spring or elastic material type, between the dome or the mandrel and a fixed part of the loudspeaker;

an electronic feedback control of the coil's position;

such a configuration of the coil and the internal and external magnetic constructions that a return force (rebalancing) is exerted on the coil by electromagnetic effect (for example, such that the value of the self-inductance of the coil is maximal for a determined position of the coil along the height of the vertical free space, within the air gap)

a deformation of the mandrel in the ferrofluidic seal area relative to the vertical generating line sweeping the mandrel, said deformation extending along the circumference of the mandrel being defined so as to create a return force proportional to the movement of the coil;

further, implementing of vertical (or even oblique) ferrofluidic seal segments, each vertical seal segment being in relation with a deformation along a segment of a vertical (or oblique) generating line of the mandrel, the vertical (or oblique) deformations being defined so as to create a return force proportional to the movement of the coil;

one or more (general or local) deformations in the area of the ferrofluidic seals, specially deformations along segments of mandrel vertical generating lines, said deformation being defined so as to create a return force proportional to the movement of the coil;

the dome-type loudspeaker comprises two internal and unilateral ferrofluidic seals of which at least one is continuous, said ferrofluidic seals being arranged in concave deformations as seen from the inside of the mandrel (the magnetic field confinement means in the vertical free space are therefore arranged at these levels), the coil being arranged on the external face of the mandrel toward the external volume (the ferrofluid being therefore advantageously arranged inside the internal volume which is much smaller than the internal volume) and the diaphragm is loaded by a quasi-closed volume on the backside of the dome, the internal magnetic construction being axially opened toward said quasi-closed volume arranged backward of the internal magnetic construction, said quasi-closed volume comprising a pneumatic leakage the time constant of which is very long relative to the frequency to be reproduced, the leakage being a port with a very small diameter toward the outside.

The advantages resulting from the invention, besides obtaining a more strong field in which the moving coil is immersed, are a reduction of the part number of the transducer, a more important displacement possibility for the coil-bearing mandrel and/or a dimension reduction given the absence of physical loopback of the magnetic field by a ferromagnetic or magnetic part between the internal and external volumes. The dynamic behavior of the transducer is improved by the fact that the inductance of the coil generally remains constant whatever the position it takes because of the absence of ferromagnetic material in the motor or, in case of presence of such materials, of an insignificant effect because of the low quantity thereof relative to traditional solutions which use a loopback of the magnetic field with a ferromagnetic part extending between the internal and external spaces of the motor.

Also, regarding the motors comprising magnets whose internal fields are concentric, toward the center of the motor, it should be known that the used magnets, which are arranged in a ring shape, are generally comprised of circular arc magnetic sectors which arc circularly juxtaposed, the internal magnetization of each sector being parallel.

If, for such a ring in an external construction, the spacing between the orientation of the parallel field lines of each segment and that of the ideal, i.e. radial, field lines causes deformations of the magnetic field to which the coil is subjected, in particular in the areas in which the sectors are adjacent, these deformations being lesser for such a ring in an internal construction.

That field deformation in the areas in which the sectors are adjacent is maximal for an internal construction because of the outward divergence of the internal field lines. It has even been noticed that this divergence lead to inward loopback of the magnetic field in that area, the field therefore reversing relative to the other parts of the magnetic ring. Therefore, the coil which is external relative to such an internal construction is not subjected to a homogenous field along the circumference thereof, some parts of the coils being subjected to reversed fields (in the areas in which the sectors are adjacent) relative to others. As a result, the global field to which the coil is subjected over the entire circumference thereof is very lesser than expected. That field reversal occurs even for adjacent sectors coming into contact with each other.

It is to be understood that this effect is also present for an external construction but in lesser extent because, this time, the internal field lines converge inwardly, that is on the coil side.

Further, the ring of the internal construction is far more curved (smaller diameter) than the ring of the external construction and the spacing between the internal magnetization orientation and the radii (ideal radial orientation of the field lines) is far greater therein.

Then, a motor having only an internal construction presents poor characteristics relative to a motor having an external construction, wherein the latter is however not optimal because of the field lines structure. Yet, combining an external construction with an internal construction improves the quality of the field in which the coil is immersed, thanks to a reciprocal guiding effect of the field lines between and within these two constructions. It has even been shown that, by combining an external construction with an internal construction, it is possible to obtain at the coil a field which is approximately twice higher than the one obtained with only an external construction. Such a gain is obtained with a quantity of magnetic material far lesser than what should be used to obtain the same result with only one construction, either external or internal.

Therefore, besides the improvement of the magnetic field structure in which the coil is immersed, of the strength thereof, weight and cost savings can be obtained.

Finally, the implementation of at least one ferromagnetic part in the given conditions allow, on one part, the increasing of the global field to which the coil is subjected by decreasing of the leakages outside the motor, and on the other part, a better control of the shape of the magnetic field plateau ends along the height direction of the motor. Further, these parts are also useful in the case in which ferrofluidic seals are implemented. Indeed, these ones are preferentially placed in areas having a great variation (gradient) of the magnetic field and a high field.

In the given explanations and hereafter, it is to be understood that the term "horizontal" for the internal fields corresponds to a cross-sectional view of a motor and that, taken as a whole, these fields are in reality substantially radial relative to the symmetry axis of the motor,

BRIEF DESCRIPTION OF THE DRAWING FIGURES

Figure 1A:
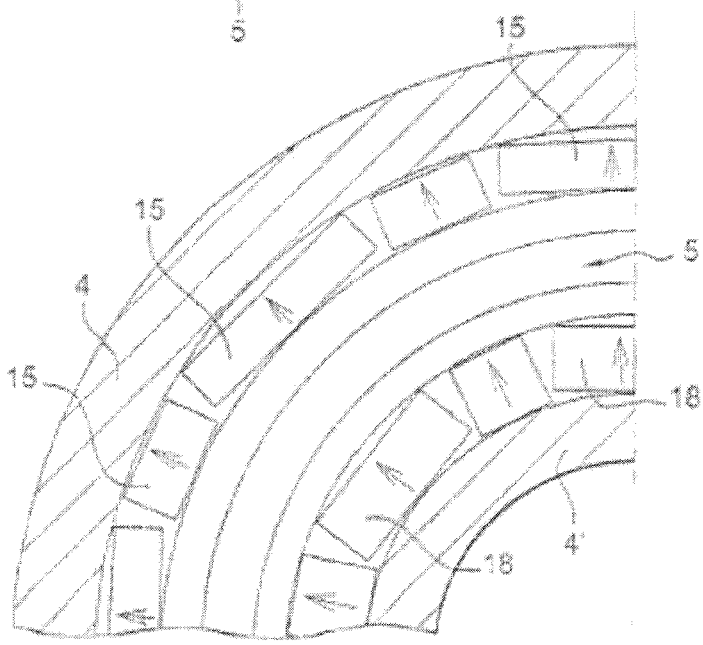

The present invention will now be exemplified, without being limited to the description given below, in conjunction with the attached drawings regarding implementations:

FIG. 1 which schematically shows a transducer having external and internal magnetic constructions each comprising three juxtaposed magnetic annular rings, the internal magnetization orientations are axial (vertical) and of opposite directions for the two lower and upper rings, the internal magnetization orientation of the intermediate (central) ring is radial (horizontal) and of additive direction relative to the two above ones regarding the magnetic induction created on the coil, supplemented by FIG. 1A which shows a part of the section A'-A' of the transducer of FIG. 1 in a composite construction of the rings;

FIG. 2 which schematically shows a transducer having external and internal magnetic constructions with globally square cross-sections, or herein rectangular cross-sections, each comprising an assembly of three complementary triangular cross-sectioned rings juxtaposed to each other (a composite assembly), or preferably, only one ring (single-piece) in which the magnetization orientation vary within the thickness of the single-piece ring material, and two coils having opposite current-flow directions;

FIG. 3 which schematically shows a transducer having external and internal magnetic constructions with globally square cross-sections or herein rectangular cross-sections, each comprising five complementary triangular cross-sectioned rings juxtaposed to each other (a composite assembly), or preferably, only one ring (single-piece) in which the magnetization orientation vary within the thickness of the single-piece ring material;

FIG. 4 which schematically shows a transducer having external and internal magnetic constructions similar to that of FIG. 3, but in which three coils having alternate current-flow directions from one coil to another (both extreme coils have the same flow direction which is opposite to the current-flow direction in the intermediate coil);

FIG. 5 which schematically shows a transducer having external and internal magnetic constructions resulting from a combining of a variant of means implemented in FIG. 2 with, for the internal magnetic construction, three triangular cross-sectioned rings and, for the external magnetic construction, two juxtaposed rings with radial (horizontal) magnetization, a ring with axial (vertical) magnetization outwardly fitting on these ones, another variant of the external magnetic construction being shown in FIG. 5*a;*

FIG. 6 which schematically shows a transducer having an external magnetic construction corresponding to a variant of means implemented in FIG. 5 for the external magnetic construction, and another variant in FIG. 6*a;*

Figure 14:
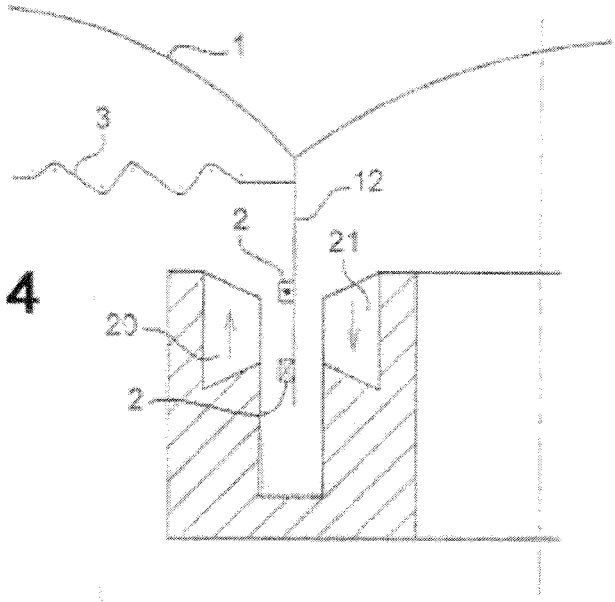
Figure 9A:
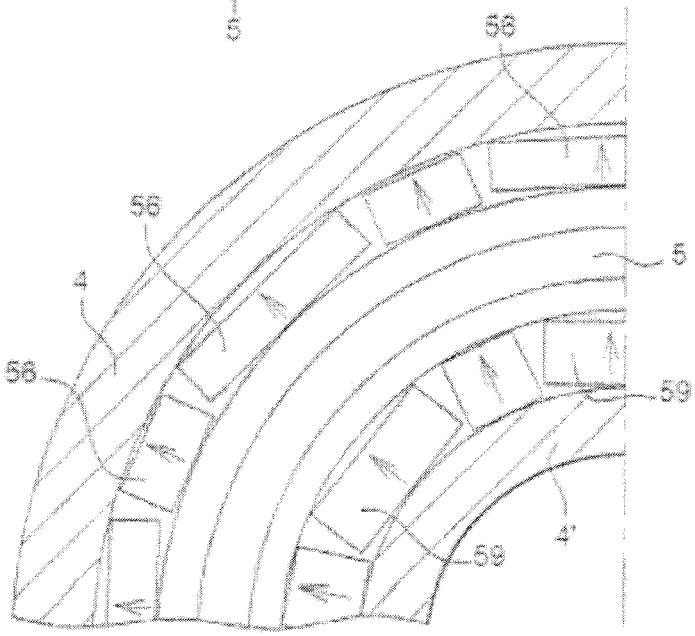
Figure 17:
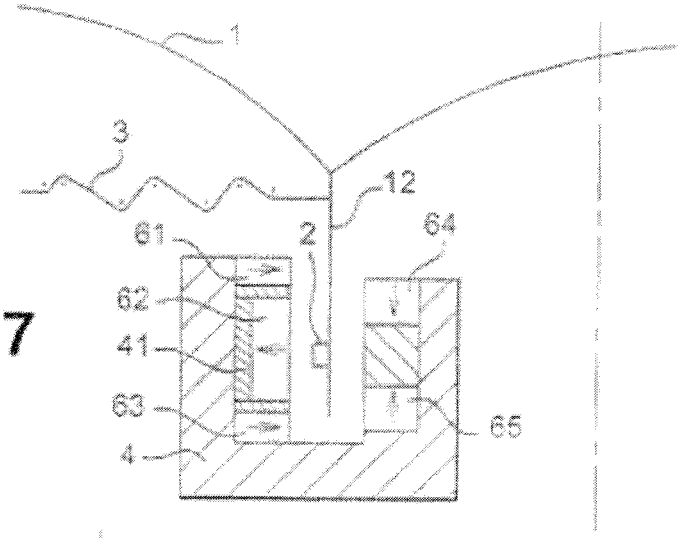
Figure 11:
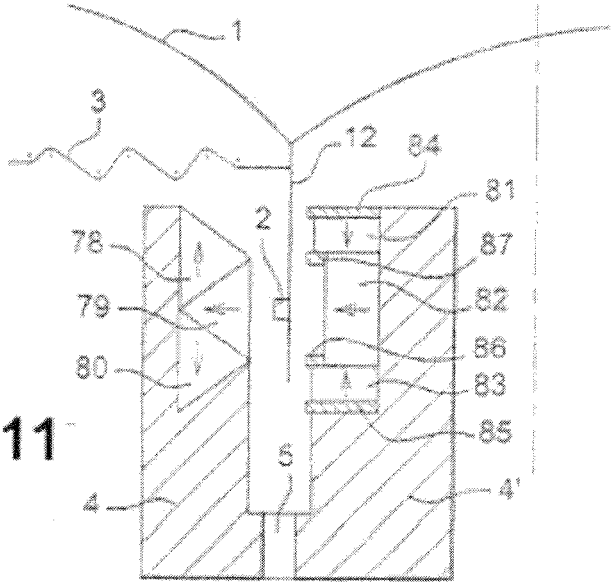
Figure 12:
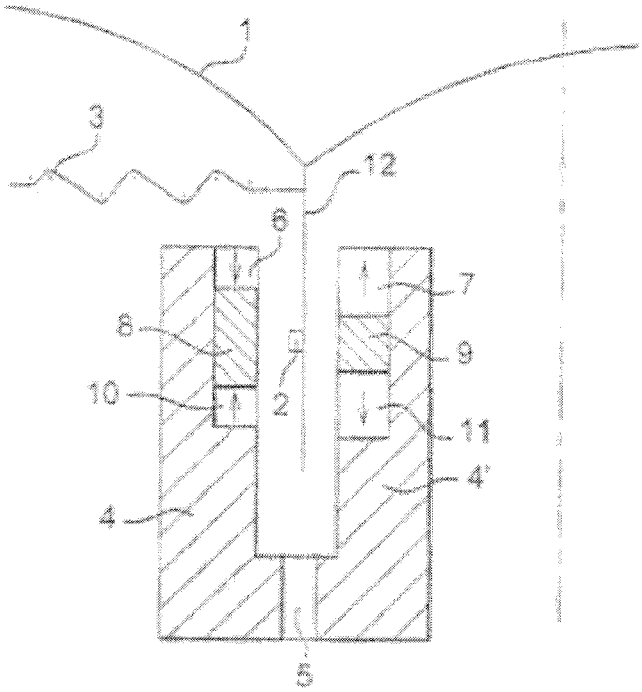
Figure 13:
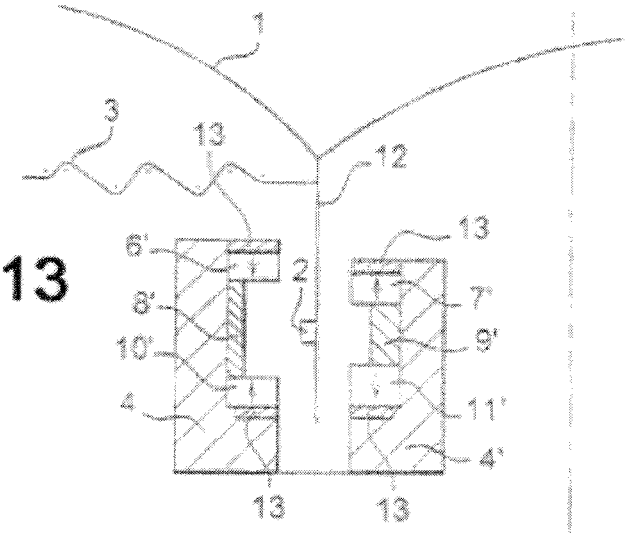

FIG. 7 which schematically shows a transducer having external and internal magnetic constructions corresponding to variants of means implemented in FIG. 4 and with three coils having alternate current-flow directions (both extreme coils have the same flow direction which is opposite to the current-flow direction in the intermediate coil);

FIG. 8 which schematically shows a transducer having external and internal magnetic constructions derived from that of FIG. 3 but without external and internal upper and lower magnets;

FIG. 9 which schematically shows a transducer having external and internal magnetic constructions each comprising three magnetic annular rings, the magnetization orientations being radial (horizontal) and in the same direction for the two lower and upper rings, the magnetization orientation of the intermediate (central) ring being radial (horizontal) but of opposite direction relative to the two above ones, supplemented by FIG. 9A which shows a part of the section A-A' of the transducer of FIG. 9;

FIG. 10 which schematically shows a transducer having external and internal magnetic constructions resulting from a variant of means implemented in FIG. 4 with external and internal magnetic constructions each comprising three juxtaposed magnetic rings, the internal magnetization orientations are axial (vertical) and of opposite directions for the two lower and upper rings, the internal magnetization orientation of the intermediate (central) ring is radial (horizontal) and of additive direction relative to the two above ones regarding the magnetic induction created on the coil, with also four ferromagnetic plates arranged two above the upper rings and two below the lower rings, and two ferromagnetic plates of internal magnetic construction at the corners of the upper and lower ends of the internal intermediate ring toward the vertical free space;

FIG. 11 which schematically shows a transducer having external and internal magnetic constructions resulting from a variant of means implemented in FIGS. 8 and 10 with external and internal magnetic constructions each comprising three juxtaposed magnetic rings, the internal magnetization orientations are axial (vertical) and of opposite directions for the two lower and upper rings, the internal magnetization orientation of the intermediate (central) ring is radial (horizontal) and of additive direction relative to the two above ones regarding the magnetic induction created on the coil, with also, on the internal magnetic construction side, two ferromagnetic plates arranged two above and below the upper and lower rings respectively and two ferromagnetic plates at the corners of the upper and lower ends of the internal intermediate ring toward the vertical free space;

FIG. 12 which schematically shows a transducer having an external magnetic construction comprising two spaced annular permanent magnets the vertical magnetization directions of which are opposite to each other, and an internal magnetic construction further comprising two spaced annular permanent magnets the vertical magnetization directions of which are opposite to each other, and for each of them opposite to the direction of the opposite external magnet;

FIG. 13 which is similar to the implementation of FIG. 12 and further comprises ferromagnetic parts of annular plates type, outside the planes defining the coil at rest and during the normal movements thereof (normal excursion range);

FIG. 14 which schematically shows a transducer having external and internal magnetic constructions each comprising a trapezoidal cross-sectioned ring the tip of which is directed toward the vertical free space and two coils having opposite current-flow directions;

FIG. 15 which schematically shows a transducer having external and internal magnetic constructions resulting from variants of means and in which the external magnetic construction comprises three magnetic rings separated by amagnetic spacers and the internal magnetic construction comprises two magnetic rings;

FIG. 16 which schematically shows a transducer having external and internal magnetic constructions each comprising a radial (horizontal) magnetization ring;

FIG. 17 which schematically shows a transducer having external and internal magnetic constructions resulting from variants of means and in which the external magnetic construction comprises three magnetic rings separated by amagnetic spacers and the internal magnetic construction comprises two magnetic rings.

DESCRIPTION OF THE PREFERRED EMBODIMENTS

In the given description of the invention, it is to be understood that means are implemented which allow the transducer's elements to be held in a fixed relation to each other, in particular the magnets and/or the coil(s) on the mandrel, which is however moving along a vertical orientation in the vertical free space. In case of application to a loudspeaker, these means are a yoke bearing the magnets and which is in an amagnetic material (non magnetic, non ferromagnetic) and, preferably, in a light alloy or a plastic material. It will be noticed that the yoke has not always been shown in some of the appended Figures in order to simplify the latter.

The means holding the mandrel are of a classical type of direct suspension or not to the yoke, and in the latter case by mean of a cone or dome-type diaphragm. In the drawings, the application of the transducer to a loudspeaker has been considered and all the loudspeaker's elements have not been shown in detail in order to simplify said drawings. In practice, a vertical plane cross-section of a dome-type loudspeaker has been shown, only the left side, the plane passing through the vertical axis of the circular symmetry of the mandrel, the dome being directed upward, as well as the direct suspension ("spider" or mandrel guiding device) to the yoke, a part of the dome and the dome suspension in order to show the external magnetic construction, possibly supplemented by an internal magnetic construction. However, the invention can be applied to other types of loudspeakers, in particular cone-type loudspeakers.

As indicated above, the internal magnetic construction can be of annular type (a ring opened in the center of the loudspeaker, along the vertical axis of symmetry) or of pellet type (solid body) for the vertical fields. If, in case of magnets having a vertical internal field direction, it is simple to make a pellet, a pellet having a horizontal internal field direction can be difficult, or event impossible, to be implemented in a simple manner and, in this case, it is preferred to use an internal magnetic construction of ring type, that is to say opened in the center of the construction. However, according to variants having more complex internal field arrangements, for example horizontal field at upper and lower ends and vertical field at intermediate level, a pellet type construction the central part of which having an essentially vertical field is contemplated. Such a configuration can correspond to a cylindrical central bar (pellet) both ends of which are in contact with tapered horizontal internal field magnets (ring or quasi-ring), the faces of the horizontal internal field magnets being inclined so as to come into contact with the tapered end, pole faces against each other (each magnet having a particular internal field direction can be a single-piece or a composite magnet: for example, for the central assembly of a bar magnet having two extremity cone-type magnets).

It will be understood that the above mentioned difficulties relate principally the making of monolithic magnets (=single-piece, that is made of only one part) for the rings, and especially for the pellets. The invention also can be implemented with composite rings and pellets, comprised of an assembly of elementary magnets which are easier to make on an individual basis (cf. for example FIG. 1A, with its assemblies of elementary magnets to form the external and internal rings). Then, according to the needs (easiness, cost . . . ), it is possible to make either a monolithic or a composite ring having a radial (horizontal) internal field. It is the same for the assembly of magnets of a construction (external or internal), which can be monolithic or composite. However, in the latter case, it will be understood that the monolithic solution will be selected for the simplest constructions, because in more complex constructions it is to obtain different internal magnetic field orientations depending of particular areas, and that in the whole cylindrical shape of the construction.

In FIG. 1, a circular loudspeaker seen from the side, in a vertical section passing through the central vertical axis of symmetry, illustrated by a vertical dot-and-dash line on the right part of the figure, shows a coil 2 at rest, fitted on a tubular mandrel 12, which is linked to the diaphragm 1 and which have a guiding suspension (or "spider") (3) enabling the vertical movement of the mandrel between the magnets in a vertical free space. The mandrel is immersed in a magnetic field comprising several field areas. Each magnet has a circular ring shape with a substantially square or rectangular cross-section. At rest, the coil 2 is immersed in an intermediate field area. Preferably, the rings are single-piece but, according to a variant, they can be composite rings comprised of an assembly of small magnets distributed along the ring's circumference. The magnets are fitted and fixed on arms 4 and 4' of a yoke made of an amagnetic material and, for example, a plastic material.

The magnets can be embedded (entirely covered) or not (only in contact or partially covered) in the material. An (optional) opening 5 is herein made in the yoke in order to provide a sufficient displacement for the mandrel if necessary and/or to balance air pressures. The coil 2 on the mandrel 12 will be lead to move out of the intermediate field area in which it moves along a free course toward field reversing upper and lower areas, in which the resulting force for a given current direction will decrease and reverse relative to that which is produced in the intermediate area.

In FIG. 1, for the external magnetic construction, three magnets are used: an external upper magnet 14 having a vertical internal field, an external lower magnet 16 having a vertical internal field, and an external intermediate magnet 15 having a horizontal internal field, between the two above ones. For the internal magnetic construction, three magnets are used: an internal upper magnet 17 having a vertical internal field, an internal lower magnet 19 having a vertical internal field, and an internal intermediate magnet 18 having a horizontal internal field, between the two above ones. The directions of the internal fields are such that there is no opposition of magnetic field liable to reduce the strength of the magnetic field in the vertical free space. In FIG. 1, the horizontal thickness of each intermediate magnet is smaller than the horizontal width of the respective upper or lower magnet but, in a not shown variant, the thickness can be the same as, or even greater than, the width of the upper or lower magnets. Three field areas are created in the vertical free space, an upper area with a first horizontal field direction, an intermediate area with a second horizontal fields direction opposite to the first direction, and lower field area with a first horizontal direction. A coil 2 on the mandrel 12 is arranged within the vertical free space, substantially at the intermediate magnets 15, 18 in the intermediate field area.

In a not shown variant, instead of being in contact, the upper, intermediate and lower magnets are separated, without however creation of more than three magnetic field areas with alternated field directions in the vertical free space. Finally, in particular in FIG. 1, the intermediate magnet 15 or 18 of the central ring can be made of an assembly of a plurality of complementary triangular cross-sectioned sectors.

FIG. 1A, section A-A' and top view, shows the schematic construction of the external 15 and internal 18 magnetic rings, herein composite rings, comprised of a circular assembly of elementary permanent magnets following the indicated radial (horizontal) orientation of the internal magnetic fields. Preferably, these magnets are caught in the material of the arms 4 and 4' of the yoke, so that they are held in place. According to a variant, these magnets are stuck on said arms.

In FIG. 2, the external and internal magnetic constructions having a globally square or rectangular cross-section, as shown, are composite constructions because they are comprised of the edge-to-edge assembly of pyramidal and/or rectangular cross-sectioned magnetic rings having particular internal field directions. The external 22 and internal 25 upper magnets have the same horizontal internal field direction. The external 24 and internal 27 lower magnets have the same horizontal internal field direction opposite to that of the upper ones 22, 25. The external 23 and internal 26 intermediate magnets have opposed vertical internal field directions. Two horizontal magnetic field areas of opposite directions are created in the vertical free space in which is immersed the mandrel bearing two coils 2 having opposite current-flow direction. Each coil is arranged in the respective upper or lower horizontal field in relation with the respective upper and lower magnets. The contacting magnetic field outgoing faces of two magnets of a construction overlap totally each other and are of opposite signs. In this example, the intermediate external magnet has a truncated-triangular cross-section and the intermediate internal magnet has a triangular cross-section.

In FIG. 3, the external and internal magnetic construction having a globally square or rectangular cross-section, as shown, are composite constructions because they are comprised of the edge-to-edge assembly of pyramidal and/or rectangular cross-sectioned magnetic rings having particular internal field directions. The external 28 and internal 33 upper magnets have the same horizontal internal field direction. The external 32 and internal 37 lower magnets have the same horizontal internal field direction similar to that of the upper ones 28, 33. The external 30 and internal 35 central magnets have the same horizontal internal field direction opposite to the direction of the upper 28, 33 or lower 32 or 37 magnets.

The external 29 and internal 34 upper intermediate magnets have opposed vertical internal field directions. The external 31 and internal 36 lower intermediate magnets have opposed vertical internal field directions. The internal field directions of the upper and lower intermediate magnets are opposite. The contacting magnetic field outgoing faces of two magnets of a construction overlap totally each other and are of opposite signs. Three horizontal magnetic field areas of alternated directions are created in the vertical free space in which is immersed the mandrel 12 bearing the coil 2: upper, central and lower magnetic fields. The coil at rest is in the central magnetic field.

The device of FIG. 4 derives from that of FIG. 3 but implements three coils carrying the current in alternatively opposite directions from one coil to another along the mandrel: a first current direction for the upper coil placed at rest in the upper magnetic field, a second current direction opposite to the first one for the central coil placed at rest in the central magnetic field, the first current direction for the lower coil placed at rest in the lower magnetic field.

It is to be noticed that it is possible to combine several embodiments together provided that they are compatibles regarding the number and the directions (and heights) of the magnetic fields created in the vertical free space by each of the magnetic constructions, such variants staying within the scope of the present invention.

In FIG. 5, the external magnetic construction comprises an upper external magnet 42 and a lower external magnet 44 having opposite horizontal internal field directions and, outwardly in the lateral direction, an external lateral magnet 43 having a vertical field direction and a height smaller than the total height of the upper 42 and lower 44 magnets, in order for the field to be able to loopback outwardly between these three magnets. In a not shown variant, the upper and lower magnets can be spaced from each other. A variant of the external construction is represented in FIG. 5*a*, in which the external lateral magnet 43 is herein a composite magnet and formed by juxtaposition of two triangular prismatic cross-sectioned magnets 49 and 49' following the field directions indicated in relation to the upper 48 and lower 50 magnets. The internal magnetic construction is of the same type of that implemented in the FIG. 2, with an internal upper magnet 45, an internal intermediate magnet 46 and an internal lower magnet 47. The internal and external upper magnets having the same horizontal internal field direction are substantially opposite to each other on either side of the vertical free space. The internal and external lower magnets having the same horizontal internal field direction are substantially in face to face relation on either side of the vertical free space. The internal field directions are such that two magnetic field areas (of maximal strength relative to other internal field direction arrangements of the magnets) are created in the vertical free space with an upper field and a lower field. The mandrel 12 bears two coils 2 carrying the current in opposite directions, the upper coil being in the upper field and the lower coil being in the lower field.

The device of FIG. 6 implements the external magnetic construction of FIG. 5 in a simplified variant without internal magnetic construction. Then, the external magnetic construction comprises an upper external magnet 42 and a lower external magnet 44 having opposite horizontal internal field directions and, outwardly in the lateral direction, an intermediate external magnet 43 having a vertical field direction and the height of which is herein smaller than the total height of the upper 42 and lower 44 magnets but which, in not shown variants, can be equal to or greater than it. According to a variant of the external construction which is shown in FIG. 6*a*, the upper 42' and lower 44' magnets are spaced from each other and the intermediate magnet 43' is arranged laterally for the field loopback.

FIG. 7 give a variant on FIG. 4 in which the intermediate magnets are composite magnets and are comprised of edge-to-edge assemblies of field outgoing faces of rings having triangular prismatic cross-section and oblique internal field directions. For example, the upper intermediate field is comprised of a first ring magnet 53 juxtaposed to a second ring magnet 54.

FIG. 8 is derived from FIG. 3 in that the internal and external upper and lower magnets are omitted. The external and internal magnetic constructions, which are then truncated-triangular cross-sectioned as represented, are composites constructions because they are comprised of the edge-to-edge assembly of magnetic rings having a triangular or truncated-triangular and/or a rectangular cross-section with particular internal field directions. The external 29' and internal 34' upper magnets have opposite vertical internal field directions. The external 31' and internal 36' lower magnets have opposite vertical internal field directions, the directions of the upper and lower magnets being further opposite for a same external construction (direction 29' opposite to 31') or internal construction (direction 34' opposite to 36'). The external 30' and internal 35' central magnets have the same horizontal internal field direction. Three horizontal magnet field areas having alternate directions are created in the vertical free space in which is immersed the mandrel 12 bearing the coil 2: upper, central and lower magnetic fields.

According to a variant, three coils having alternate current-flow directions from one coil to another can be implemented, each coil being in one of the field areas in the vertical free space, the two extreme coils having the same current-flow direction.

In FIG. 9, three magnets are used externally: an external upper magnet 55 having a horizontal (radial) internal field, an external lower magnet 57 having a horizontal internal field and an external intermediate magnet 56 having a horizontal internal field between the two above ones. Internally, three magnets are used: an internal upper magnet 58 having a horizontal internal field, an internal lower magnet 60 having a horizontal internal field and an internal intermediate field 59 having a horizontal internal field between the two above ones. The horizontal internal field directions of the external and internal upper magnets 55, 58 and lower magnets 57, 60 are the same and are opposite to the horizontal internal field directions of the external and internal intermediate magnets 56, 59. In FIG. 9, besides the disposition, the horizontal width of each intermediate magnet is smaller than the horizontal width of the respective upper and lower magnets. According to a variant, the widths can be equal to each other, or even the width of the upper intermediate magnet can be greater than the other widths because the loopback of the field occurs through parallel, and thus non contacting, outgoing faces of the magnets. According to a variant enabling channeling of the magnetic fields, on the face of the magnetic construction opposite to that bounding the vertical free space can be arranged a pair of juxtaposed magnets, of the same type as the magnets 49 and 49' in FIG. 5*a*, the signs of the contacting pole faces being opposite, the intermediate magnet 56 or 59 sharing the field thereof between each one of the magnets of each pair. In this latter case, the corresponding face of the magnetic construction will be indented.

Three field areas are created in the vertical free space, an upper area having a first horizontal field direction, an intermediate area having a second horizontal field direction opposite to the first direction, and an lower field area having a first horizontal direction. A coil 2 on the mandrel 12 is arranged at rest in the vertical free space, at the intermediate magnets 15, 18 level in the intermediate field area. According to a variant, three coils having alternate current-flow directions (same current-flow direction for the upper and lower fields, opposite direction for the intermediate field) are arranged in the vertical free space, each coil being at rest located in one of the field areas.

FIG. 9A, section A-A' and top view, shows the schematic construction of the external 56 and internal 59 magnetic rings, herein composite rings, comprised of a circular assembly of elementary permanent magnets following the indicated radial orientation of the magnetic fields. Preferably, these magnets are caught in the material of the arms 4 and 4' of the yoke, so that they are held in place. According to a variant, these magnets are stuck on said arms.

The device of FIG. 10 result from a variant of the means implemented in FIG. 1, with external and internal magnetic constructions each comprising three juxtaposed magnetic coils, the internal magnetization orientations are axial (vertical) and of opposite directions for the two lower 68/71 and upper 66/69 rings of a same construction (respectively internal or external), whereas they are of opposite directions for the upper, respectively lower, rings of the internal and external constructions. The internal magnetization orientation of the intermediate (central) rings 67/70 is radial (horizontal) and of additive direction relative to the two above ones regarding the magnetic induction created on the coil, and of the same direction for the internal and external constructions. The device of FIG. 10 further comprises four ferromagnetic, plate crown-shaped plates, arranged two 72, 74 above the upper rings 66, 69, and two 73, 75 below the lower rings 68, 71. The internal magnetic construction further comprises two ferromagnetic, plate crown-shaped plates 76, 77 at the corners of the upper and lower ends of the internal intermediate magnet, toward the vertical free space. It can be noticed that the thickness of the internal intermediate magnet 70 is smaller than the width of the internal upper 69 and lower 71 magnets and that the two corner's plates 76, 77 come against a part of the internal field outgoing faces of the upper and lower magnets. The ferromagnetic plates 72, 74, and respectively 73, 75, are substantially in a face to face relation on either side of the vertical free space. The ferromagnetic plates 72, 73, 74, 75, 76, 77 project into the vertical free space. The ferromagnetic plates 72, 73, 74, 75, 76, 77 are such that they are saturated by the magnetic field, so that they behave virtually as amagnetic elements from the magnetic permeability point of view.

The device of FIG. 11 results from a variant of means implemented in FIGS. 8 and 10, with external and internal magnetic constructions each comprising three juxtaposed magnetic rings. The external magnetic construction is of the same type as that of FIG. 8 (but with reverse internal fields). The internal magnetic construction is of the same type as that of FIG. 10. The internal magnetization orientations are axial (vertical) and of opposite direction for the two lower 80/83 and upper 78/81 rings of a same construction (respectively internal or external), whereas they are of opposite directions for the upper, respectively lower, rings of the internal and external constructions. The internal magnetization orientation of the intermediate (central) rings 79/82 is radial (horizontal) and of additive direction relative to the two above ones regarding the magnetic induction created on the coil, and of the same direction for the internal and external constructions. The magnets of the globally truncated-triangular cross-sectioned external magnetic construction have complementary triangular (or truncated-triangular) cross-sections. The magnets of the globally rectangular (or even square) cross-sectioned internal magnetic construction have complementary rectangular or square cross-sections. Ferromagnetic plates of the same type as that of FIG. 10 for the internal construction are implemented. These ferromagnetic plates 84, 85, 86, 87 are such that they are saturated by the magnetic field, so that they behave virtually as amagnetic elements from the magnetic permeability point of view.

In FIG. 12, a circular loudspeaker seen from the side, in a vertical section passing through the central vertical axis of symmetry, illustrated by a vertical dot-and-dash line on the right part of the figure, shows a coil 2 at rest, fitted on a tubular mandrel 12, which is linked to the diaphragm 1 and which have a guiding suspension (or "spider") enabling the vertical movement of the mandrel between four magnets in a vertical free space, two external magnets, an external upper (or top) one 6 and an external lower (or bottom) 10 having vertical and opposite internal field directions, and two internal magnets, an internal upper (or top) one 7 and an internal lower (or bottom) one 11 having vertical and opposite internal field directions. The external 6 and internal 7 upper magnets have opposite internal field directions and the mandrel is then immersed in a magnetic field comprising three field areas, two upper and lower areas having the same horizontal magnetic field direction and an intermediate area having a reverse horizontal direction relative to the two above ones. Each of the magnets has a circular ring shape having a substantially square or rectangular cross-section. At rest, the coil 2 is immersed in the intermediate field area. Preferably, the rings are single-piece but, according to a variant, they can be composite rings comprised of an assembly of small magnets distributed along the ring's circumference.

The internal and external upper and lower magnets are separated by a gap 8 for the outside and by a gap 9 for the inside. The magnets are fitted and fixed on the arms 4 and 4' of a yoke made of an amagnetic material and, for example, a plastic material. The gaps 8 and 9 herein comprise such a material but they can also comprise a light alloy or copper, or even stay material free. The magnets can be embedded (entirely covered) or not (only in contact or partially covered) in the material. An (optional) opening 5 is herein made in the yoke in order to provide a sufficient displacement for the mandrel if necessary and/or to balance air pressures. The coil 2 on the mandrel 12 will be lead to move out of the intermediate field area in which it moves along a free course toward field reversing upper and lower areas, in which the resulting force for a given current direction will decrease and reverse relative to that which is produced in the intermediate area.

The device of FIG. 13 is similar to that of FIG. 12 but with further crown-shaped plates 13 comprised of a ferromagnetic material at the top of the external upper magnet 6' and the internal upper magnet 7' and at the bottom of the external lower magnet 10' and internal lower magnet 11'. Further, herein, the amagnetic material (herein shown different between the external and internal parts of the motor) does not totally fill the external 8' and internal 9' gaps. The ferromagnetic plates are arranged on the field outgoing faces of the magnets and cover them totally (top plates) or partially (bottom plates). These plates, which are ferromagnetic parts in the motor (and which, in all cases they are present, never extend between the external volume and the internal volume) modify only a little, or even in an insignificant manner, the inductance of the coil (or of the coils according to the possible variants of the motor), because said ferromagnetic parts are saturated by the magnetic field and the magnetic permeability properties thereof are then close to that of the amagnetic material.

The external and internal upper magnets (the same goes for the lower ones) are arranged at such heights that they are substantially in a face to face relation on either side of the mandrel, but a little offset in relation to the ones of FIG. 12. Three field areas are also created in the vertical free space and the coil 2 at rest is arranged in the intermediate area. During its normal movements (normal excursion), the coil does not arrive at the height of the plates. The presence of the plates 13 does not substantially modify the value of the inductance of the coil at rest, immobilized in the motor, or if a modification exists it does not go beyond twice and not under half the inductance value of the same coil, when free and isolated in the space.

In FIG. 14, only two magnets 20 and 21 of trapezoid-shaped ring type and two coils having opposite current-flow directions are implemented. Each coil is arranged at rest at the respective inclined upper or lower surface (the edge in the section of FIG. 14) in the vertical free space.

The device of FIG. 15 results from a combining of variants of magnetic constructions above described. For the external magnetic construction, three magnets are implemented, but the upper magnet 38, the intermediate magnet 39 and the lower magnet 40 are separated by an amagnetic material 41. The internal magnetic construction is similar to that of FIG. 12. It is thus shown, by this example, that it is possible to combine several embodiments together provided that they are compatibles regarding the number and the directions (and heights) of the magnetic fields created in the vertical free space by each of the magnetic constructions, such variants staying within the scope of the present invention.

FIG. 16 gives a simplified variant with two substantially rectangular cross-sectioned ring magnets, an external one 51 and an internal one 52 having the same horizontal internal field direction and a coil 2. Three field areas having alternate directions are created in the vertical free space.

The device of FIG. 17 results from a combining of variants of the magnetic constructions above described. For the external magnetic construction, three magnets are implemented but the upper magnet 61, the intermediate magnet 62 and the lower magnet 63 are separated by an amagnetic material 41. The internal magnetic fields of the external upper ant lower magnets 61, 63 have the same horizontal orientation and a direction opposite to that of the horizontal external intermediate magnet 62. The internal magnetic construction is similar to that of FIG. 12 with an upper internal magnet 64 separated by a lower internal magnet 65 having opposite vertical internal fields. On either side of the vertical free space in which the mandrel 12 and the coil 2 are located, the internal fields of the magnets are oriented in order for the three fields (upper, intermediate, lower) created in said vertical free space to be maximal (that is, they add up). The coil can comprise only one winding at the intermediate magnet 62 as shown, or, according to a variant, three windings having alternate winding directions (more generally, of alternate current-flow directions), two of the same direction substantially at the external upper magnet 61 and lower magnet 63 and one of opposite direction at the external intermediate magnet 62. It is to be noticed that, given that for the external magnetic construction the outgoing pole faces of the magnets are parallel to each other, the separation of the magnets by an amagnetic material 41 is not essential and there are less constraints on the width and the horizontal thickness of the magnets. As indicated as a variant for FIG. 16, with means for the channeling of magnetic fields, it is also possible to arrange, as a variant, a pair of juxtaposed magnets on the face of the magnetic construction which is opposite to that bounding the vertical free space.

Finally, in all these motor configurations, it is possible to implement a ferromagnetic liquid (ferrofluid) in the vertical free space. The ferromagnetic liquid tends naturally to position itself in areas in which the magnetic field is the greatest or its variation the highest, forming one/some ferrofluidic seals and, besides the improved thermal dissipation, it can act as a pneumatic seal (if it is continuous) between the front side and the rear side of the diaphragm, and, in all cases (continuous or not), improve the translation guidance of the mandrel in the vertical free space up to enable the suppression of external mechanical guiding elements for the mandrel, such as the edge of the diaphragm and/or the "spider". So, it is implemented magnetic field concentrating means inside the magnetic construction(s), or even outside the magnetic constructions (what enables the use of magnetic constructions according to the invention that can be used with or without ferrofluid—thus standardized—and with adding of magnetic field concentrating means for the use of ferrofluid) at the levels at which ferrofluidic seals are desired.

The ferrofluidic liquid (ferrofluid) can be arranged in the vertical free space on each side of the mandrel (bilateral seal or unilateral seals) but, according to some variants, it possible to arrange it on only one side of the mandrel (unilateral seal) either inside the internal volume or inside the external volume.

The use of ferromagnetic liquid in the motor according to the invention is particularly interesting because field concentration areas can be created in the vertical free space in which the ferromagnetic liquid will concentrate. By creating at least two field concentration areas on either side of the coil (or of the coils or, further, between the coils), it is possible to make ferrofluidic seals with ferromagnetic liquid at different heights of the mandrel. These ferrofluidic seals extend horizontally, at least between one of the two walls of the vertical free space (magnetic construction) and the respective face of the mandrel, forming an unilateral ferrofluidic seal (either internal or external), and, at maximum, horizontally extended (at the same level) on one side between a first of the two walls of the vertical free space and the respective face of the mandrel, and on the other side between the other face of the mandrel and the second wall of the vertical free space, forming a bilateral ferrofluidic seal.

Preferably, in case of at least two unilateral seals, these ones are either together on the inner side of the mandrel or together on the outer side of the mandrel (however, according to a variant, it is possible to alternate the unilateral seals on each side of the mandrel). The selection of the side where to place the unilateral seals can be linked to the fact that the coil forms a protuberance on the mandrel and that the mandrel will thus have to be spaced from the face bounding the free space opposite the coil (the side of it) for the latter to not rub against said face, and the seals are then placed on the other side (if the coil is on the outer side of the mandrel, the seals will be on the inner side of the mandrel).

It will be understood that these seals (at least two stepped seals along the mandrel) ensure by them-selves a holding and a double guidance of the mandrel (guiding function) in the vertical free space. It is then possible to suppress the suspension means classically used in the loudspeakers, that is the edges and the "spiders" which have guidance, sealing and returning functions. Therefore, one of the ferrofluidic seals will have to be continuous over the circumference of the mandrel (unilateral or bilateral seal) in order to pneumatically isolate the rear part of the diaphragm (inside the loudspeaker) from the front part of the diaphragm (which corresponds to the loudspeaker's environment) because, in a loudspeaker having a edge-type suspension, this edge acts as an isolation between the front side and the rear side of the diaphragm, what avoids an acoustical short-circuit between the two faces of the diaphragm. Such an edgeless-and-spiderless configuration is preferably implemented in a loudspeaker the diaphragm of which is a dome (concave or convex, or an association of both). During the dome's displacements, the magnetic field confinement means in the air gap, which are inside the internal and/or external magnetic construction(s) (preferably, in both ones in a face to face relation) and which are fixed, stay efficient to ensure the structural coherence of the ferrofluidic seals during the movement of the coil-bearing mandrel.

Preferably, each ferrofluidic seal is, along the mandrel's circumference, in a unique own plane perpendicular to the symmetry axis of the mandrel. According to some alternatives/variants, the seal along the mandrel's circumference can draw a profiled curve (sinusoidal, triangular, square frieze, rectangular . . . ) and form a profiled seal. In the latter case, given that a same seal runs at different heights along the mandrel's circumference, a unique seal of this type can ensure a double guidance. These ferrofluidic seals are continuous (at least one of them) or discontinuous. Further, according to some variants, segments of vertical or oblique seals can be implemented. The field confinement means are adapted accordingly. It is to be understood that the substantially horizontal parts of seals in deformations of the mandrel fulfill a predominant returning function upon, the (optionally) vertical or oblique parts of the seals in deformations of the mandrel ensuring a regular sliding of the mandrel and a possible returning function (according the shape of the mandrel's deformations, in particular of the top and bottom ends thereof).

Finally, if the implementation of ferrofluidic seals having a guiding and sealing function in a dome-type loudspeaker, without edge-and-spider type suspension, is done with the motor according to the invention, this implementation can also be done with a classical iron motor.

It is to be understood that the given implementation illustrations of the invention are illustrative and that it is possible to use reverse directions of magnets to obtain equivalent results or to interchange internal and/or external magnetic constructions and/or to combine internal and external magnetic constructions of several described examples to reach equivalent results.

In particular, for all the asymmetric configurations, that is the configurations whose internal and external constructions are not similar (symmetrically speaking), it is to be understood that it is possible to reverse them (mirror reversal). Finally, for the internal field directions and orientations, the given figures indicate the constructions which give optimized results, and it is thus preferable to use these indications in order to obtain best results, the other possible configurations (other than the external/internal mirror reversals) being less successful.

The invention claimed is:

1. Electrodynamic transducer, comprising:

a yoke with at least one electrical coil (2) placed in a static magnetic field can move about a rest position in an excursion range of a vertical free space, the coil(s) being wound and fixed on a segment of circular or elliptical cross-sectioned vertical straight cylinder forming a mandrel (12), a return mean enabling the mandrel bearing the coil(s) to be returned to the rest position in the absence of an external bias, the straight cylinder defining an internal volume toward the inside of said cylinder defining an external volume toward the outside of said cylinder, wherein, the magnetic field is produced by an external magnetic construction comprising at least one ring-shaped fixed permanent magnet arranged in the external volume as well as an internal magnetic construction comprising at least one ring-shaped or pellet-shaped fixed permanent magnet arranged in the internal volume, the external and internal magnetic constructions are substantially in a face to face relation on either side of the vertical free space, a motor comprising no ferromagnetic or magnetic part extending between the external volume and the internal volume, the yoke, at least in the part thereof holds the magnets in a fixed position, said motor being made of a non-ferromagnetic and nonmagnetic material, and a ratio R of the inductance value $L_p$ of the coil at the rest position and blocked in the transducer to the inductance value $L_1$ of the same coil when free and isolated in the space, namely $R=L_p/L_1$, has a value comprised between 0.5 and 2 in the useful frequency band of the transducer.

2. Transducer according to claim 1, wherein the ratio R remains comprised between 0.9 and 1.1 in the presence of a ferromagnetic part.

3. Transducer according to claim 1, wherein the transducer does not comprise any ferromagnetic part and the ratio R is substantially equal to 1.

4. Transducer according to claim 1, further comprising at least one ferromagnetic part, said ferromagnetic part being present with the transducer and not extending between the external volume and the internal volume and being not either arranged in the volume defined by the horizontal planes passing through the ends of the coil(s) at a rest position.

5. Transducer according to claim 1, said transducer is a loudspeaker, said loudspeaker comprising:

means such that, during the upward or downward movements of the mandrel, movements which are produced by a current having a corresponding given direction, the mandrel is braked after a free course about the rest position, the resultant force decreasing and reversing for the same current direction beyond the free course, the one or at least one of the coils being then subjected to a magnetic field of reverse direction relative to the magnetic field direction to which it was previously subjected, and in the external and/or internal magnetic constructions, in a vertical arrangement, an upper magnet (6, 7, 6', 7', 14, 17, 38, 64, 66, 69, 81) separated from a lower magnet (10, 11, 10', 11', 16, 19, 40, 57, 60, 65, 68, 71, 83) by a gap, the magnets having a substantially square or rectangular cross-section and having their internal fields vertically oriented and of opposite directions, the magnets in a face to face relation on either side of the vertical free space having their internal fields of opposite directions.

6. Transducer according to claim 5, further comprising a substantially square or rectangular cross-sectioned fixed intermediate magnet (15, 1 8, 39, 67, 70, 82) arranged in the gap and having a horizontal internal field direction, so that the intermediate magnetic field in the vertical free space has a reverse direction relative to the direction of the two upper and lower magnetic fields of said vertical free space, for a maximal loopback of the field lines.

7. Transducer according to claim 1, wherein said transducer is a loudspeaker, said loudspeaker comprising:

means such that, during the upward or downward movements of the mandrel, movements which are produced by a current having a corresponding given direction, the mandrel is braked after a free course about the rest position, the resultant force decreasing and reversing for the same current direction beyond the free course, the one or at least one of the coils being then subjected to a magnetic field of reverse direction relative to the magnetic field direction to which it was previously subjected, and in the external and/or internal magnetic constructions a globally square or rectangular cross-sectioned composite ring or pellet, comprised of a stack of juxtaposed magnets, each magnet having a prismatic section, and specially a triangular or truncated-triangular cross-section, and the adjacent internal field outgoing pole faces of two juxtaposed magnets are of opposite signs, with from top to bottom:

an upper magnet (28, 33) having a first direction of horizontal internal field and whose vertical height decreases as the distance from the vertical free space increases, an upper intermediate magnet (29, 34) having a first direction of vertical internal field, a central magnet (30, 35) having a second direction of horizontal internal field opposite to the first direction of horizontal internal field and whose vertical height decreases as the distance from the vertical free space increases, a lower intermediate magnet (31, 36) having a second direction of vertical internal field opposite to the first direction of vertical internal field, a lower magnet (32, 37) having a first direction of horizontal internal field and whose vertical height decreases as the distance from the vertical free space increases, the directions of the horizontal and vertical internal fields of the magnets being such that the central magnetic field in the vertical free space is of reverse direction relative to the direction of the two upper and lower magnetic fields of the vertical free space, and for a maximal loopback of the field lines, the transducer having a coil arranged at rest substantially at the height of the central magnet or three coils with alternate currentflow directions arranged at rest substantially at the height of the upper, central and lower magnets respectively.

8. Transducer according to claim 1, wherein said transducer is a loudspeaker, said loudspeaker comprising:

means such that, during the upward or downward movements of the mandrel, movements which are produced by a current having a corresponding given direction, the mandrel is braked after a free course about the rest position, the resultant force decreasing and reversing for the same current direction beyond the free course, the one or at least one of the coils being the sujected to a magnetic field of reverse direction relative to the magnetic field direction to which it was previously subjected, and on one part, in the substantially truncated-triangular cross-sectioned external magnetic construction, in a vertical arrangement, and external upper magnet (29') seperated from an external lower magnet (31') by an external gap, the external magnets having a triangular or truncated-triangular cross-sectioned ring shape and having their internal fields vertically oriented and of opposite directions, and on the other hand, in the substantially truncated- triangular cross-sectioned internal magnetic construction, in a vertical arrangement, an internal upper magnet (34') separated from an internal lower magnet (36') by an internal gap, the internal magnets having a triangular cross-sectioned ring shape and having their internal fields vertically oriented and of opposite directions, the internal and external upper magnets being substantially at the shame height on either side of the vertical free space and of opposite internal field directons, the internal and external lower magnets being substantially at the same height on either side of the vertical free space and of opposite internal field directions, the height of the gap increasing as the distance from the vertical free space decreases, a fixed external intermediate magnet (30') having a triangular cross-sectioned ring shape being arranged in the external gap and a fixed internal intermediate magnet (35') having a triangular cross-sectioned ring shape being arranged in the internal gap, the internal field of the external and internal intermediate magnets being of the same direction and horizontally oriented, so that the magnetic field in the vertical free space comprises three magnetic field areas having alternate directions, and for a maximal loopback of the field lines, the respective intermediate, upper and lower magnets, either external magnets or internal magnets, being complementarily juxtaposed, the transducer having at least one coil arranged at rest substantially at the height of the intermediate magnets.

9. Transducer according to claim 3, wherein said transducer is a loudspeaker, said loudspeaker comprising:

means such that, during the upward or downward movements of the mandrel, movements which are produced by a current having a corresponding given direction, the mandrel is braked after a free course about the rest position, the resultant force decreasing and reversing for the same current direction beyond the free course, the one or at least one of the coils being then subjected to a magnetic field of reverse direction relative to the magnetic field direction to which it was previously subjected, on one part, in the external magnetic construction, in a vertical arrangement, an external upper magnet (66) separated from an external lower magnet (68) by an external gap, the external magnets having their internal fields vertically oriented and of opposite directions, and on the other hand, in the internal magnetic construction, in a vertical arrangement, an internal upper magnet (69) separated from an internal lower magnet (71) by an internal gap, the internal magnets having their internal fields vertically oriented and of opposite directions, the internal (69) and external (66) upper magnets being substantially at the same height on either side of the vertical free space and of opposite internal field directions, the internal (71) and external (68) lower magnets being substantially at the same height on either side of the vertical free space and of opposite internal field directions, an external intermediate magnet (67) being arranged in the external gap and an internal intermediate magnet (70) being arranged in the internal gap, the internal and external intermediate magnets having the same horizontal internal field direction, so that the intermediate magnetic field in the vertical free space has a reverse direction relative to the direction of the two upper and lower magnetic fields of said vertical free space, for a maximal loopback of the field lines, the respective intermediate, upper and lower magnets, either external magnets or internal magnets, being juxtaposed to each other and being substantially square or rectangular cross-sectioned rings, the transducer having only one coil arranged at rest substantially at the height of the external and internal gaps, and four ferromagnetic plates arranged two (72, 74) above the external and internal upper magnets (66, 69) and two (73, 75) below the external and internal lower magnets (68, 71), and optionally two ferromagnetic plates (76, 77) in the internal magnetic construction at the corners of the upper and lower ends of the internal intermediate magnet (70) toward the vertical free space.

10. Transducer according to claim 1, said transducer is a loudspeaker, said loudspeaker comprising:

means such that, during the upward or downward movements of the mandrel, movements which are produced by a current having a corresponding given direction, the mandrel is braked after a free course about the rest position, the resultant force decreasing and reversing for the same current direction beyond the free course, the one or at least one of the coils being then subjected to a magnetic field of reverse direction relative to the magnetic field direction to which it was previously subjected, and the external and internal magnetic constructions each comprise a substantially square or rectangular cross-sectioned magnet (51, 52) the internal field of which is horizontally oriented and in the same direction for both.

11. Transducer according to claim 2, wherein the transducer does not comprise any ferromagnetic part and the ratio R is substantially equal to 1.

12. Transducer according to claim 2, further comprising at least one ferromagnetic part, said ferromagnetic part not extending between the external volume and the internal volume and being not either arranged in the volume defined by the horizontal planes passing through the ends of the coil(s) at a rest position.

13. Transducer according to claim 2, wherein said transducer is a loudspeaker, said loudspeaker comprising:

means such that, during the upward or downward movements of the mandrel, movements which are produced by a current having a corresponding given direction, the mandrel is braked after a free course about the rest position, the resultant force decreasing and reversing for the same current direction beyond the free course, the one or at least one of the coils being then subjected to a magnetic field of reverse direction relative to the magnetic field direction to which it was previously subjected, and in the external and/or internal magnetic constructions, in a vertical arrangement, an upper magnet (6, 7, 6', 7', 14, 17, 38, 64, 66, 69, 81) separated from a lower magnet (10, 11, 10', 11', 16, 19, 40, 57, 60, 65, 68, 71, 83) by a gap, the magnets having a substantially square or rectangular cross-section and having their internal fields vertically oriented and of opposite directions, the magnets in a face to face relation on either side of the vertical free space having their internal fields of opposite directions.

14. Transducer according to claim 2, wherein said transducer is a loudspeaker, said loudspeaker comprising:

means such that, during the upward or downward movements of the mandrel, movements which are produced by a current having a corresponding given direction, the mandrel is braked after a free course about the rest position, the resultant force decreasing and reversing for the same current direction beyond the free course, the one or at least one of the coils being then subjected to a magnetic field of reverse direction relative to the magnetic field direction to which it was previously subjected, and in the external and/or internal magnetic constructions a globally square or rectangular cross-sectioned composite ring or pellet, comprised of a stack of juxtaposed magnets, each magnet having a prismatic section, and specially a triangular or truncated-triangular cross-section, and the adjacent internal field outgoing pole faces of two juxtaposed magnets are of opposite signs, with from top to bottom:

an upper magnet (28, 33) having a first direction of horizontal internal field and whose vertical height decreases as the distance from the vertical free space increases, an upper intermediate magnet (29, 34) having a first direction of vertical internal field, a central magnet (30, 35) having a second direction of horizontal internal field opposite to the first direction of horizontal internal field and whose vertical height decreases as the distance from the vertical free space increases, a lower intermediate magnet (31, 36) having a second direction of vertical internal field opposite to the first direction of vertical internal field, a lower magnet (32, 37) having a first direction of horizontal internal field and whose vertical height decreases as the distance from the vertical free space increases, the directions of the horizontal and vertical internal fields of the magnets being such that the central magnetic field in the vertical free space is of reverse direction relative to the direction of the two upper and lower magnetic fields of the vertical free space, and for a maximal loopback of the field lines, the transducer having a coil arranged at rest substantially at the height of the central magnet or three coils with alternate currentflow directions arranged at rest substantially at the height of the upper, central and lower magnets respectively.

15. Transducer according to claim 2, wherein said transducer is a loudspeaker, said loudspeaker comprising:

means such that, during the upward or downward movements of the mandrel, movements which are produced by a current having a corresponding given direction, the mandrel is braked after a free course about the rest position, the resultant force decreasing and reversing for the same current direction beyond the free course, the one or at least one of the coils being then subjected to a magnetic field of reverse direction relative to the magnetic field direction to which it was previously subjected, and on one part, in the substantially truncated-triangular cross-sectioned external magnetic construction, in a vertical arrangement, an external upper magnet (29') separated from an external lower magnet (31') by an external gap, the external magnets having a triangular or truncated-triangular cross-sectioned ring shape and having their internal fields vertically oriented and of opposite directions, and on the other hand, in the substantially truncated- triangular cross-sectioned internal magnetic construction, in a vertical arrangement, an internal upper magnet (34') separated from an internal lower magnet (36') by an internal gap, the internal magnets having a triangular cross-sectioned ring shape and having their internal fields vertically oriented and of opposite directions, the internal and external upper magnets being substantially at the same height on either side of the vertical free space and of opposite internal field directions, the internal and external lower magnets being substantially at the same height on either side of the vertical free space and of opposite internal field directions, the height of the gap increasing as the distance from the vertical free space decreases, a fixed external intermediate magnet (30') having a triangular cross-sectioned ring shape being arranged in the external gap and a fixed internal intermediate magnet (35') having a triangular cross-sectioned ring shape being arranged in the internal gap, the internal field of the external and internal intermediate magnets being of the same direction and horizontally oriented, so that the magnetic field in the vertical free space comprises three magnetic field areas having alternate directions, and for a maximal loopback of the field lines, the respective intermediate, upper and lower magnets, either external magnets or internal magnets, being complementarily juxtaposed, the transducer having at least one coil arranged at rest substantially at the height of the intermediate magnets.

16. Transducer according to claim 2, wherein said transducer is a loudspeaker, said loudspeaker comprising:

means such that, during the upward or downward movements of the mandrel, movements which are produced by a current having a corresponding given direction, the mandrel is braked after a free course about the rest position, the resultant force decreasing and reversing for the same current direction beyond the free course, the one or at least one of the coils being then subjected to a magnetic field of reverse direction relative to the magnetic field direction to which it was previously subjected, and the external and internal magnetic constructions each comprise a substantially square or rectangular cross-sectioned magnet (51, 52) the internal field of which is horizontally oriented and in the same direction for both.

17. Transducer according to claim 3, wherein said transducer is a loudspeaker, said loudspeaker comprising means:

such that, during the upward or downward movements of the mandrel, movements which are produced by a current having a corresponding given direction, the mandrel is braked after a free course about the rest position, the resultant force decreasing and reversing for the same current direction beyond the free course, the one or at least one of the coils being then subjected to a magnetic field of reverse direction relative to the magnetic field direction to which it was previously subjected, and in the external and/or internal magnetic constructions, in a vertical arrangement, an upper magnet (6, 7, 6', 7', 14, 17, 38, 64, 66, 69, 81) separated from a lower magnet (10, 11, 10', 11', 16, 19, 40, 57, 60, 65, 68, 71, 83) by a gap, the magnets having a substantially square or rectangular cross-section and having their internal fields vertically oriented and of opposite directions, the magnets in a face to face relation on either side of the vertical free space having their internal fields of opposite directions.

18. Transducer according to claim 3, wherein said transducer is a loudspeaker, said loudspeaker comprising:

means such that, during the upward or downward movements of the mandrel, movements which are produced by a current having a corresponding given direction, the mandrel is braked after a free course about the rest position, the resultant force decreasing and reversing for the same current direction beyond the free course, the one or at least one of the coils being then subjected to a magnetic field of reverse direction relative to the magnetic field direction to which it was previously subjected, and in the external and/or internal magnetic constructions a globally square or rectangular cross-sectioned composite ring or pellet, comprised of a stack of juxtaposed magnets, each magnet having a prismatic section, and specially a triangular or truncated-triangular cross-section, and the adjacent internal field outgoing pole faces of two juxtaposed magnets are of opposite signs, with from top to bottom:

an upper magnet (28, 33) having a first direction of horizontal internal field and whose vertical height decreases as the distance from the vertical free space increases, an upper intermediate magnet (29, 34) having a first direction of vertical internal field, a central magnet (30, 35) having a second direction of horizontal internal field opposite to the first direction of horizontal internal field and whose vertical height decreases as the distance from the vertical free space increases, a lower intermediate magnet (31, 36) having a second direction of vertical internal field opposite to the first direction of vertical internal field, a lower magnet (32, 37) having a first direction of horizontal internal field and whose vertical height decreases as the distance from the vertical free space increases, the directions of the horizontal and vertical internal fields of the magnets being such that the central magnetic field in the vertical free space is of reverse direction relative to the direction of the two upper and lower magnetic fields of the vertical free space, and for a maximal loopback of the field lines, the transducer having a coil arranged at rest substantially at the height of the central magnet or three coils with alternate currentflow directions arranged at rest substantially at the height of the upper, central and lower magnets respectively.

19. Transducer according to claim 3, wherein said transducer is a loudspeaker, said loudspeaker comprising:

means such that, during the upward or downward movements of the mandrel, movements which are produced by a current having a corresponding given direction, the mandrel is braked after a free course about the rest position, the resultant force decreasing and reversing for the same current direction beyond the free course, the one or at least one of the coils being then subjected to a magnetic field of reverse direction relative to the magnetic field direction to which it was previously subjected, and on one part, in the substantially truncated-triangular cross-sectioned external magnetic construction, in a vertical arrangement, an external upper magnet (29') separated from an external lower magnet (31') by an external gap, the external magnets having a triangular or truncated-triangular cross-sectioned ring shape and having their internal fields vertically oriented and of opposite directions, and on the other hand, in the substantially truncated- triangular cross-sectioned internal magnetic construction, in a vertical arrangement, an internal upper magnet (34') separated from an internal lower magnet (36') by an internal gap, the internal magnets having a triangular cross-sectioned ring shape and having their internal fields vertically oriented and of opposite directions, the internal and external upper magnets being substantially at the same height on either side of the vertical free space and of opposite internal field directions, the internal and external lower magnets being substantially at the same height on either side of the vertical free space and of opposite internal field directions, the height of the gap increasing as the distance from the vertical free space decreases, a fixed external intermediate magnet (30') having a triangular cross-sectioned ring shape being arranged in the external gap and a fixed internal intermediate magnet (35') having a triangular cross-sectioned ring shape being arranged in the internal gap, the internal field of the external and internal intermediate magnets being of the same direction and horizontally oriented, so that the magnetic field in the vertical free space comprises three magnetic field areas having alternate directions, and for a maximal loopback of the field lines, the respective intermediate, upper and lower magnets, either external magnets or internal magnets, being complementarily juxtaposed, the transducer having at least one coil arranged at rest substantially at the height of the intermediate magnets.

20. Transducer according to claim 3, wherein said transducer is a loudspeaker, said loudspeaker comprising:

means such that, during the upward or downward movements of the mandrel, movements which are produced by a current having a corresponding given direction, the mandrel is braked after a free course about the rest position, the resultant force decreasing and reversing for the same current direction beyond the free course, the one or at least one of the coils being then subjected to a magnetic field of reverse direction relative to the magnetic field direction to which it was previously subjected, and the external and internal magnetic constructions each comprise a substantially square or rectangular cross-sectioned magnet (51, 52) the internal field of which is horizontally oriented and in the same direction for both.

* * * * *